US007951291B2

(12) United States Patent
Nino

(10) Patent No.: US 7,951,291 B2
(45) Date of Patent: May 31, 2011

(54) AUTOMATIC FLUID CHANNEL SCREEN LOCK-UNLOCK SYSTEM

(76) Inventor: Khalil Ibrahim Nino, South Gate, CA (US)

( * ) Notice: Subject to any disclaimer, the term of this patent is extended or adjusted under 35 U.S.C. 154(b) by 95 days.

(21) Appl. No.: 12/154,603

(22) Filed: May 22, 2008

(65) Prior Publication Data

US 2008/0226390 A1 Sep. 18, 2008

Related U.S. Application Data

(60) Provisional application No. 61/048,167, filed on Apr. 25, 2008.

(51) Int. Cl.
*E03F 5/14* (2006.01)

(52) U.S. Cl. ..... 210/131; 210/156; 210/162; 210/163; 404/4

(58) Field of Classification Search ..... 210/131, 210/156, 162, 163, 164, 170.03, 407; 404/4, 404/5

See application file for complete search history.

(56) References Cited

U.S. PATENT DOCUMENTS 73,159 A 1/1868 Besse (Continued)

FOREIGN PATENT DOCUMENTS

WO 2006053562 A1 5/2006

OTHER PUBLICATIONS

Yasser M. El-Gamal (Orrick, Herrington & Sutcliffe LLP); Ecology Control Industries, Inc.'s Memorandum In Support Of Motion For Preliminary Injunction [Document 16 filed Mar. 9, 2009 in *Ecology Control Industries, Inc.* v. *West Coast Storm, Inc.*, U.S. District Court, Central District of California (the Court) Case 2:09-cv-00435-PA-PLA]; dated Mar. 9, 2009; caption page and pp. 12-15 (Subsection F) [Document 16, pp. 1 & 17-20 of 30]; published by the Court, in Los Angeles, CA.

(Continued)

*Primary Examiner* — Christopher Upton
(74) *Attorney, Agent, or Firm* — Aaron L. Patton

(57) ABSTRACT

The present invention relates to a screen lock-unlock system for automatically locking and unlocking a screen that is within a fluid channel wherein the screen is rotatable relative to the channel from closed to open. The system includes an actuator comprising a flapper and a trigger, wherein the flapper is rotatably connectable to the back of the screen. The flapper is operably connected to the trigger for moving the trigger. And, the system is further summarized, according to one aspect, as follows. It includes a lock bar wherein the lock bar is rotatably attachable to a screen support structure, the lock bar being rotatable by movement of the trigger. The lock bar intercepts the rearward arc path of a blockable part (such as a flange extending laterally from the screen). The flapper is located and oriented with respect to the closed screen for at least part of the flapper to be rotatable in response to pressure from impact fluid. The trigger is located sufficiently close to the lock bar for rotation of the trigger to move the lock bar in a direction and amount needed for at least part of the lock bar to clear the blockable part, allowing the screen to open in response to pressure against the front of the screen. The screen is rotatable toward a closed position in response to the diminishment of the pressure against the front of the screen. And, the lock bar is biased in a counter-rotation direction (by part of the lock bar and/or another biasing device) to at least help hold the lock bar in and/or return it to a locked position.

20 Claims, 12 Drawing Sheets

U.S. PATENT DOCUMENTS

| | | | | |
|---|---|---|---|---|
| 171,567 | A | 12/1875 | Huffaker | |
| 231,544 | A | 8/1880 | Darst | |
| 248,559 | A | 10/1881 | Jackson | |
| 316,854 | A | 4/1885 | Van Auken | |
| 440,067 | A | 11/1890 | Smith | |
| 506,267 | A | 10/1893 | Sefton | |
| 930,829 | A | 8/1909 | Bolling | |
| 961,834 | A | 6/1910 | Barlett | |
| 1,066,316 | A | 7/1913 | Piper | |
| 1,143,496 | A | 6/1915 | Briles | |
| 1,220,123 | A * | 3/1917 | Heybach | 404/4 |
| 1,245,903 | A | 11/1917 | Gross | |
| 1,302,839 | A | 5/1919 | Olson | |
| 1,382,589 | A | 6/1921 | Ziegler | |
| 1,666,756 | A | 4/1928 | Sass | |
| 1,999,637 | A | 4/1935 | Pettepher | |
| 2,198,943 | A | 4/1940 | Lowe | |
| 4,073,147 | A | 2/1978 | Nomura | |
| 4,594,157 | A | 6/1986 | McGowan | |
| 4,935,129 | A | 6/1990 | Wang | |
| 4,986,693 | A | 1/1991 | Salberg et al. | |
| 5,577,863 | A | 11/1996 | Nottle | |
| 5,702,595 | A | 12/1997 | Mossburg, Jr. | |
| 5,944,445 | A | 8/1999 | Montgomery | |
| 6,015,489 | A * | 1/2000 | Allen et al. | 210/131 |
| 6,017,166 | A | 1/2000 | Mossburg, Jr. | |
| 6,217,756 | B1 * | 4/2001 | Martinez | 210/163 |
| 6,287,050 | B1 | 9/2001 | Montgomery et al. | |
| 6,390,730 | B1 | 5/2002 | Scheibe | |
| 6,402,942 | B2 | 6/2002 | Cardwell et al. | |
| 6,478,954 | B1 | 11/2002 | Turner, Jr. et al. | |
| 6,485,231 | B2 | 11/2002 | Montgomery et al. | |
| 6,623,209 | B1 | 9/2003 | Waters, Jr. | |
| 6,668,390 | B1 | 12/2003 | Gonzalez | |
| 6,733,665 | B1 * | 5/2004 | Khalil | 210/156 |
| 6,821,053 | B2 * | 11/2004 | Martinez | 404/4 |
| 6,824,677 | B2 * | 11/2004 | Martinez | 210/162 |
| 6,869,523 | B2 * | 3/2005 | Martinez | 210/156 |
| 6,972,088 | B2 * | 12/2005 | Yehuda | 210/156 |
| 6,974,540 | B1 | 12/2005 | Fleischmann | |
| 7,083,359 | B2 | 8/2006 | Aughton et al. | |
| 7,179,371 | B1 | 2/2007 | Bistline | |
| 7,234,894 | B1 * | 6/2007 | Flury | 210/163 |
| 7,238,279 | B2 * | 7/2007 | Saurenman et al. | 210/131 |
| 7,467,911 | B2 | 12/2008 | Flury | |
| 7,491,338 | B2 * | 2/2009 | Nino | 210/156 |
| 7,611,304 | B2 | 11/2009 | Lill et al. | |
| 2004/0009041 | A1 | 1/2004 | Aughton et al. | |
| 2004/0069697 | A1 | 4/2004 | Martinez | |
| 2004/0173513 | A1 | 9/2004 | Nino | |
| 2005/0035038 | A1 | 2/2005 | Fallon | |
| 2006/0083592 | A1 | 4/2006 | Aughton et al. | |
| 2007/0086856 | A1 | 4/2007 | Lill et al. | |
| 2008/0014021 | A1 | 1/2008 | Flury | |
| 2009/0120855 | A1 | 5/2009 | Flury | |
| 2009/0208289 | A1 | 8/2009 | Flury | |
| 2009/0236293 | A1 * | 9/2009 | Alvarado | 210/163 |
| 2010/0147752 | A1 | 6/2010 | Jarvis, Jr. et al. | |

OTHER PUBLICATIONS

Reggie Estrada; Letter from West Coast Storm, Inc. to Gene Estrada, City of Orange re West Coast Drain Flap Quote [redactions added]; Exhibit 4 to Decl. of Robert W. Dickerson in Support of Plaintiff's Motion for Preliminary Injunction [Document 17-3 filed Mar. 9, 2009 in *Ecology Control Industries* v. *West Coast Storm, Cent. Dist. Of Calif.*(the Court) Case 2:09-cv-00435-PA-PLA]; dated Apr. 17, 2007; Exhibit 4 pgs. 14-15 [Doc. 17-3, pp. 43-44 of 44]; believed pub. by City of Orange about Aug. 2007, in City of Orange, and (as Doc. 17-3) by the Court, in Los Angeles, CA.

James William Jones; Declaration of Dr. James William Jones in Support of Plaintiff's Motion for Preliminary Injunction [Document 18 filed Mar. 9, 2009 in *Ecology Control Industries, Inc.* v. *West Coast Storm, Inc.*, U.S. District Court, Central District of California (the Court) Case 2:09-cv-00435-PA-PLA]; dated Mar. 6, 2009; caption page and pp. 2-11 [Document 18, pp. 1-11 of 11]; published by the Court, in Los Angeles, CA.

James William Jones; Exhibit B Documents and Things Reviewed; Exhibit B to Declaration of Dr. James William Jones in Support of Plaintiff's Motion for Preliminary Injunction [part of Document 18-2 filed Mar. 9, 2009 in *Ecology Control Industries, Inc.* v. *West Coast Storm, Inc.*, U.S. District Court, Central District of California (the Court) Case 2:09-cv-00435-PA-PLA]; presumed prepared Mar. 6, 2009; one page [Document 18-2, p. 11 of 62]; published by the Court, in Los Angeles, CA.

West Coast Storm, Inc.; drawing sheets; Exhibit C to Decl. of Dr. James William Jones in Support of Plaintiff's Motion for Preliminary Injunction [part of Document 18-2 filed Mar. 9, 2009 in *Ecology Control Industries* v. *West Coast Storm*, U.S. Dist. Court, Cent. Dist. of Calif. (the Court) Case 2:09-cv-00435-PA-PLA]; dated May 1, 2008 rev A, Jun. 26, 2008 rev B (except on Exhibit C p. 46, rev B is Dec. 15, 2008) and Oct. 7, 2008 rev C; Exhibit C pp. 1-23, 46-47 & 49 [Doc. 18-2, pp. 13-35, 58-59 & 61 of 62]; pub. By City of Los Angeles and (as Doc. 18-2) by the Court, in Los Angeles, CA.

James William Jones; Claim Chart for U.S. Patent No. 7,467,911; Exhibit E to Declaration of Dr. James William Jones in Support of Plaintiff's Motion for Preliminary Injunction [Document 18-4 filed Mar. 9, 2009 in *Ecology Control Industries, Inc.* v. *West Coast Storm, Inc.*, U.S. District Court, Central District of California (the Court), Case 2:09-cv-00435-PA-PLA]; presumed prepared on Mar. 6, 2009; Exhibit E pp. 1-12 [Document 18-4, pp. 2-13 of 13]; published by the Court, in Los Angeles, CA.

Gregory O. Bryant; Declaration of Gregory O. Bryant in Support of Defendant's Opposition to Plaintiff's Motion for Preliminary Injunction [Document 27 filed Mar. 23, 2009 in *Ecology Control Industries, Inc.* v. *West Coast Storm, Inc.*, U. S. District Court, Central District of California (the Court), Case 2:09-cv-00435-PA-PLA]; dated Mar. 22, 2009; caption page and pp. 1-7 [Document 27, pp. 1-8 of 8]; published by the Court, in Los Angeles, CA.

Gregory O. Bryant; Exhibit B Documents Reviewed; Exhibit B to Declaration of Gregory O. Bryant in Support of Defendant's Opposition to Plaintiffs Motion for Preliminary Injunction [Document 27-3 filed Mar. 23, 2009 in *Ecology Control Industries, Inc.* v. *West Coast Storm, Inc.*, U.S. District Court, Central District of California (the Court), Case 2:09-cv-00435-PA-PLA]; presumed prepared on Mar. 22, 2009; one page [Document 27-3, p. 2 of 2]; published by the Court, in Los Angeles, CA.

Gregory O. Bryant; 10 photos of West Coast Storm catch basin inlet covers, 5 of "Cover #1" and 5 of "Cover #2"; Exhibit D to Declaration of Gregory O. Bryant in Support of Defendant's Opposition to Plaintiff's Motion for Preliminary Injunction [Document 27-5 filed Mar. 23, 2009 in *Ecology Control Industries, Inc.* v. *West Coast Storm, Inc.*, U.S. District Court, Central District of California (the Court), Case 2:09-cv-00435-PA-PLA]; presumed prepared on Mar. 22, 2009; 10 pages (1 photo per page) [Document 27-5, pp. 2-11 of 11]; published by the Court, in Los Angeles, CA.

Yasser M. El-Gamal (Orrick, Herrington & Sutcliffe LLP); Ecology Control Industries, Inc.'s Reply Memorandum In Support Of Motion For Preliminary Injunction [Court Document 43 filed Mar. 30, 2009 in *Ecology Control Industries, Inc.* v. *West Coast Storm, Inc.*, U.S. District Court, Central District of California (the Court), Case 2:09-cv-00435-PA-PLA]; dated Mar. 30, 2009; caption page and pp. 4-11 (Section III) [Document 43, pp. 1 & 9-16 of 17]; published by the Court, in Los Angeles, CA.

James William Jones; Reply Declaration of Dr. James William Jones in Support of Plaintiffs Motion for Preliminary Injunction [Document 43-2 filed Mar. 30, 2009 in *Ecology Control Industries, Inc.* v. *West Coast Storm, Inc.*, U.S. District Court, Central District of California (the Court), Case 2:09-cv-00435-PA-PLA]; dated Mar. 30, 2009; caption page and pp. 2-16 [Court Document 43-2, pp. 1-16 of 16]; published by the Court, in Los Angeles, CA.

Tara L. Mayo; USPTO Office communication [Office Action] re U.S. Appl. No. 11/821,623; Exhibit A to Reply Declaration of Dr. James William Jones in Support of Plaintiff's Motion for Preliminary Injunction [part of Document 43-3 filed Mar. 30, 2009 in *Ecology Control Industries, Inc.* v. *West Coast Storm, Inc.*, U.S. District Court, Central District of California (the Court), Case 2:09-cv-00435-PA-PLA]; dated Jun. 30, 2008; Exhibit A pp. 1-6 [Document 43-3, pp. 2-7 of 52]; pub. by USPTO in VA and (on about Mar. 30, 2009) by the Court, in Los Angeles, CA.

Robert W. Dickerson; Written Statement of Interview on Sep. 23, 2008 and Response to Jun. 30, 2008 Office Action; Exhibit C to Reply Declaration of Dr. James William Jones in Support of Plaintiff's Motion for Preliminary Injunction [part of Document 43-3 filed Mar. 30, 2009 in *Ecology Control Industries* v. *West Coast Storm*, U.S. Dist. Court, Cent. Dist. of Calif. (the Court), Case 2:09-cv-00435-PA-PLA]; dated Sep. 25, 2008; Exhibit C pp. 1-22 [Document 43-3, pp. 23-44 of 52]; pub. by USPTO in VA and (as Document 43-3) by the Court, in Los Angeles, CA.

Yasser M. El-Gamal (Orrick, Herrington & Sutcliffe LLP); Ecology Control Industries, Inc.'s Infringement Contentions Pursuant to Court Order of Mar. 30, 2009 [Document 55 filed May 4, 2009 in *Ecology Control Industries, Inc.* v. *West Coast Storm, Inc.*, U.S. District Court, Central District of California (the Court), Case 2:09-cv-00435-PA-PLA]; dated May 4, 2009; pp. 1-5 [Court Document 55, pp. 1-5 of 5]; published by the Court, in Los Angeles, CA.

Yasser M. El-Gamal (Orrick, Herrington & Sutcliffe LLP); Exhibit A—Ecology Control Industries, Inc.'s Infringement Contentions [Document 55-2 filed May 4, 2009 in *Ecology Control Industries, Inc.* v. *West Coast Storm, Inc.*, U.S. District Court, Central District of California (the Court), Case 2:09-cv-00435-PA-PLA]; presumed prepared on about May 4, 2009; pp. 2-19 [Document 55-2, pp. 2-19 of 19]; published by the Court, in Los Angeles, CA.

Marc A. Karish (Sheldon Mak Rose & Anderson PC); Defendant West Coast Storm, Inc.'s Invalidity Contentions Pursuant to Court Order of Mar. 30, 2009 [Document 59 filed Jun. 3, 2009 in *Ecology Control Industries, Inc.* v. *West Coast Storm, Inc.* , U.S. Dist. Court, Central District of California (the Court), Case 2:09-cv-00435-PA-PLA]; dated Jun. 3, 2009; caption page and pp. 1-6 [Document 59, pp. 1-7 of 10]; published by the Court, in Los Angeles, CA.

Marc A. Karish (Sheldon Mak Rose & Anderson PC); Exhibit A1—Invalidity Contentions For U.S. Patent No. 7,467,911 In View Of ECI's Own Products In Public Use and On Sale More Than One Year Prior To The Filing Date of U.S. Patent No. 7,467,911 As Represented By Plaintiff [Document 59-2 filed Jun. 3, 2009 in *Ecology Control Industries* v. *West Coast Storm*, U.S. Dist. Court, Cent. Dist. of Calif. (the Court), Case 2:09-cv-00435-PA-PLA]; presumed prepared about Jun. 3, 2009; pp. 1-12 [doc. 59-2, pp. 1-12 of 12]; pub. by the Court, in Los Angeles, CA.

Marc A. Karish (Sheldon Mak Rose & Anderson PC); Exhibit A2—Invalidity Contentions For U.S. Patent No. 7,467,911 In View Of U.S. Patent No. 1,382,589 to Ziegler [Document 59-3 filed Jun. 3, 2009 in *Ecology Control Industries, Inc.* v. *West Coast Storm. Inc.* , U.S. Dist. Court, Central District of California (the Court), Case 2:09-cv-00435-PA-PLA]; presumed prepared about Jun. 3, 2009; pp. 1-8 [Doc. 59-3, pp. 1-8 of 8]; published by the Court, in Los Angeles, CA.

Marc A. Karish (Sheldon Mak Rose & Anderson PC); Exhibit A3—Invalidity Contentions For U.S. Patent No. 7,467,911 In View Of Bolling (U.S. Patent No. 930,829) [Document 59-4 filed Jun. 3, 2009 in *Ecology Control Industries, Inc.*, v. *West Coast Storm, Inc.*, U.S. District Court, Central District of California (the Court), Case 2:09-cv-00435-PA-PLA]; presumed prepared about Jun. 3, 2009; pp. 1-8 [doc. 59-4, pp. 1-8 of 8]; published by the Court, in Los Angeles, CA.

Marc A. Karish (Sheldon Mak Rose & Anderson PC); Exhibit A4—Invalidity Contentions For U.S. Patent No. 7,467,911 In View Of U.S. Patent No. 316,854 to Van Auken [Document 59-5 filed Jun. 3, 2009 in *Ecology Control Industries Inc.*, v. *West Coast Storm Inc.*, U.S. Dist. Court, Cent. Dist. of Calif. (the Court), Case 2:09-cv-00435-PA-PLA]; presumed prepared about Jun. 3, 2009; pp. 1-8 [Doc. 59-5, pp. 1-8 of 8]; published by the Court, in Los Angeles, CA.

City of Los Angeles; Attachment B, Specifications For Catch Basin Opening Screen Covers, [part of Request For Quotation (RFQ) #EV00001182 Catch Basin Opening Screen Covers]; dated Dec. 3, 2007 (but RFQ #EV00001182 dated Jan. 2, 2008); pp. 1, 7-8 & 11-13 of 14; published with said RFQ by City of Los Angeles Department of General Services—Supply Services Division, in Los Angeles, CA.

City of Los Angeles; Addendum #02, Request For Quotation No. EV-1182—Catch Basin Opening Screen Covers; dated Feb. 1, 2008; pp. 1 and 3; published (as supplement to RFQ #EV00001182) by City of Los Angeles Department of General Services—Supply Services Division in Los Angeles, CA.

City of Los Angeles; Addendum #03, Request For Quotation No. EV-1182—Catch Basin Opening Screen Covers; dated Feb. 19, 2008; pp. 1, 5, and 6; published (as supplement to RFQ #EV00001182) by City of Los Angeles Department of General Services—Supply Services Division in Los Angeles, CA.

Ecology Control Industries American Storm Water Division; Catch Basin Opening Screen Cover set of drawings; undated but believed submitted to City of Los Angeles (City) on Mar. 18, 2008 in a bid responding to City RFQ #EV00001182; drawing sheets 1-4, 6, and 9-11 of 11; believed first published by City on about Jun. 6, 2008, in Los Angeles, CA.

Waterway Solutions, LLC; Top-Swing Gate description with set of related drawings; drawings dated Feb. 28, 2008, all believed submitted to City of Los Angeles (City) on Mar. 18, 2008 in a bid responding to City RFQ #EV00001182; pages: description page and drawing pages (sheets) 1/2 & 2/2 (Standard Top-Swing Curb-Opening Screened Cover Installation), 1/6 & 2/6 (Standard . . . Assembly), 316 & 4/6 (Standard . . . Door Weldment), and 5/6 & 6/6 (Standard . . . Hydro-Lock Weldment); believed first published by City on about Jun. 06, 2008, in Los Angeles, CA.

Waterway Solutions, LLC; Model 302-2 Top-Swing Gate description with set of related drawings; drawings dated Feb. 28, 2008, all believed submitted to City of Los Angeles (City) on Mar. 18, 2008 in a bid responding to City RFQ #EV00001182; pages: description page and drawing pages (sheets) 1/2 & 212 (Model 302-2 Curb-Opening Screened Cover Installation), 1/6 & 2/6 (Model 302-2 . . . Assembly), 3/6 & 4/6 (Model 302-2 . . . Door Weldment), and 5/6 & 6/6 (Model 302-2 . . . Hydro-Lock Weldment); believed first published by City on about Jun. 6, 2008, in Los Angeles, CA.

West Coast Storm, Inc.; West Coast Storm Screen set of drawings; undated but believed submitted to City of Los Angeles (City) on Mar. 18, 2008 in a bid responding to City RFQ #EV00001182 (resulting in award of City contract #58872 to West Coast Storm, Inc. on about May 23, 2008); 2 unnumbered drawing pages (sheets); believed first published by City on about Jun. 6, 2008, in Los Angeles, CA.

West Coast Storm, Inc.; West Coast Storm, Inc. set of drawings for (per note in upper left quadrant of sheet 1) fabrication of field units [ARS (automated retractable screen) units] to be used in [City of Los Angeles (City)] contract 58872; dated May 1, 2008 (original & rev. A) and Jun. 26, 2008 (rev. B), believed submitted to City in May 2008 (orig. & rev. A), Jul. 2008 (rev. B), and (for Addendum 1, added as sheet 16 of 16) Aug. 2008; drawing sheets 1-15 of 15 (total "of 15" should now read "of 16") and 16 of 16; believed first published by City in about Aug. 2008, in Los Angeles, CA.

Aaron L. Patton, Summary Of Telephone Calls Re Third-Party's Patent Application Publication And Possible Claim Of Interference; dated Jul. 26, 2010; two pages; published by USPTO in the Image File Wrapper for U.S. Appl. No. 12/154,603 and described as Transmittal Letter Filed on (mail room date of ) Jul. 26, 2010; published on internet at USPTO web site with access available via Public at http://portal.uspto.gov/external/portal/pair.

* cited by examiner

AUTOMATIC FLUID CHANNEL SCREEN LOCK-UNLOCK SYSTEM

CROSS-REFERENCE TO RELATED APPLICATIONS

This application is derived from U.S. Provisional Application No. 61/048,167, filed Apr. 25, 2008, and claims the benefit of said Provisional Application.

BACKGROUND OF THE INVENTION

The present invention relates to a system of mechanical components arranged to cooperate with each other for locking and unlocking a rotatable screen that is located for intercepting the flow of fluid through a channel such as a catch basin curb inlet channel. More particularly, the present invention relates to such a system that holds the screen closed to impede the movement of fluid-borne trash under low fluid-flow conditions but automatically releases the hold for allowing the screen to rotate open in order to permit an increased volume of the fluid (and trash carried with it) to move downstream past the screen during high fluid-flow conditions, and then automatically resumes its hold when the screen re-closes upon dissipation of the high fluid-flow conditions.

As used herein ("herein" being inclusive of this specification, including its claims, and accompanying drawings), "screen" includes any physical device having apertures for allowing fluid to pass through the device while blocking such passage of at least some trash. Examples of said devices, which may differ in part based on the size of their apertures, include screens, filters, sieves, grids, grates, and gates.

As used herein, "trash," means any item of natural or man-made solid material, including any comprised of trash, debris, vegetation, one or more sticks, one or more rocks, all or part of an animal, or any combination thereof, that is large enough to be blocked by the screen, as determined by the size(s) of the openings in the screen. And, "trash" is used as a reference to such items sometimes singly and sometimes plurally as indicated by the context. Of course, any given screen may be unable to block some items of trash with a dimension larger than the screen's openings, particularly where those items are elongated, compressible, and/or flexible enough to sometimes pass through the openings.

As used herein, "channel" means any inlet, catch basin, channel, conduit, pipe, culvert, tube or any other man-made or natural confinement, or any system comprising some or all of these elements, through which fluid flows on at least some occasions. Channels, particularly drainage channels, often include a catch basin. The catch basin is typically located near the channel's beginning point; that is, near the point at which fluid first enters the channel system.

As used herein, "fluid" means any fluid, or combination of fluids, that is normally or reasonably expected to be carried by the channel in which an automatic screen fluid channel lock-unlock system, as described and/or shown herein, is installed.

Trash tends to be moved by fluid and thereby enter into channels that collect or direct the flow of the fluid. It is generally desirable to minimize the amount of trash in the channel, particularly items of trash that are too large for the channel to move throughout its length during light or moderate flow periods or that are large enough to create an environmental, aesthetic, health, or other problem, such as an obstruction or a build up, near the discharge end of the channel. On the other hand, it is desirable for channels to be available for receiving and moving large amounts of fluid during heavy flow periods. The need for these desirable features is particularly apparent when considered in the context of a street or highway storm drain system.

Streets and highways frequently have curb inlets leading to catch basins as the initial entry points of drainage systems for collecting and draining water and other fluids that would otherwise accumulate in and ultimately flood the street or highway. It is desirable to minimize the entry of solid materials that are larger than a relatively small size, in order to reduce the frequency needed for cleaning such materials out of the system, and to reduce the potential for animals or even small children entering through the inlets.

It may be observed that many curb inlets have no effective means for blocking the entry of trash. There have been ideas put forward that involve installation of a trash blocking device at the inlet but typically those devices require manual cleaning or removal to relieve the damming effect of an accumulation of trash during periods of heavy fluid flow. (See, e.g., U.S. Pat. No. 4,986,693, issued to Salberg et al. on Jan. 22, 1991; U.S. Pat. No. 5,702,595, issued to Mossburg, Jr. on Dec. 30, 1997; U.S. Pat. No. 6,017,166, issued to Mossburg, Jr. on Jan. 25, 2000; and, U.S. Pat. No. 6,402,942, issued to Cardwell et al. on Jun. 11, 2002.) Of course, during light flow periods, when the amount of accumulated trash at the entrance is relatively small and does not significantly impede the flow of fluid into the drainage system, street and highway maintenance personnel have no immediate need to clear the curb inlets and are at liberty to do so according to a schedule without significant risk of a flood occurring.

However, during periods of heavy flow, due to storms or other events that produce substantial amounts of fluid in the streets and highways, it is imperative that any significant impediment to the flow of such fluid into the drainage system be removed. These heavy flow periods often commence unexpectedly or on very short notice and, in some geographical areas, frequently. Thus, installation of most previously proposed blocking devices for curb inlet channels would put maintenance personnel under extreme pressure to mount an intensive and expensive effort to remove the blocking devices whenever heavy flow periods occur. Removal of such blocking devices generally requires personnel to expend substantial time and, in some cases, to use expensive equipment in order to access and remove the connecting means and the devices.

Nevertheless, such removal is necessary because the trash accumulated at the face of the blocking devices significantly impedes the large volume of fluid that is flowing into the drain system, thus causing a damming effect. Also, the blocking devices will continue to block and accumulate the additional trash that is being carried with the large volume of fluid, exacerbating the damming effect. Therefore, unless agencies that have responsibility for street and highway maintenance and/or flood control either forgo the benefits of having blocking devices or expend large sums for personnel and equipment to immediately remove the blocking devices every time a heavy flow period threatens or commences, the accumulations at the entrances to their drainage systems are very likely to cause substantial flooding.

It has been suggested that a blocking device made of elastic plastic material is needed to overcome the prohibitive cost, weight, and installation difficulties, found in blocking devices made of metal or other non-plastic material. And, further, that the prior devices made of metal or other non-plastic material are not particularly suitable for installation within a curb inlet channel and generally do not, without human assistance, clear the accumulated trash during periods of heavy flow. It has also been contended that attaching the heavy components of metal blocking devices with bolts anchored within the inlet or catch basin will weaken and over-stress that structure. (See U.S. Pat. No. 6,015,489, issued to Allen et al. on Jan. 18, 2000, which discloses a plastic self-relieving curb inlet filter that is secured by adhesive along its top edge within the curb inlet and is sufficiently elastic to flex open in response to increasing pressure and unflex toward its closed position as the pressure is reduced.) Such a device offers advantages that may be achieved from the use of plastic and adhesive materials. However, the advantages also appear to be limited by those materials. The strength, flexibility and elasticity of plastics and adhesives may be adversely affected by repeated flexing and extended exposure to environmental conditions such as sun, air, water, and extreme temperature variations (ranging from above 100 degrees Fahrenheit to well below 0 degrees Fahrenheit in some geographical areas). A secure bond may be difficult to achieve or maintain in circumstances where the surface (generally made of concrete) suffers from irregularities, impurities, or mechanical weaknesses; and, if achieved, may be difficult to remove without some damage to the surface or the device. And, the efficacy of the device in opening and closing is dependent on the elasticity of the material used. Thus, if a very elastic material is used, the device may open with little pressure applied, such as during periods of light to medium fluid flow when remaining closed is generally desired. And, if a very inelastic material is used, the device may not open fully even when the initial resistance is overcome by a large pressure (the degree of resistance in such materials often increasing with the degree of flexure), which is generally when full opening is most desired. Such a device, therefore, provides no effective means of control to assure the blockage is maintained when that is most desirable and released when that is most desirable.

Consequently, as indicated above, it appears that some of the prior efforts at blocking the passage of trash in channels, and particularly in catch-basin curb inlets, were directed primarily either at the use of rigid heavy materials for devices that were expensive and difficult to install and remove, or at use of elastic plastic material for making a device that would open and close in response to the pressure caused by a high level of fluid and accumulated trash. It also appears that those efforts did not address or suggest a practical and economical solution to the problem of trash accumulation and blockage during heavy flow periods when the passage of fluid needs to be maximized. However, that problem was addressed by suggesting the use of relatively light metal components that include a rotatable grid positioned in the inlet channel (e.g., by the grid being connected to a rod running proximate the grid's upper edge with the rod connected to a support on either end; and, include a hold and release means that employs one or more magnets (which could be replaced by, or combined with, other hold-release means, such as a latch or other mechanical gripping device (which generally require that one part of the device be connected to the grid's support and another part be connected to the grid), provided the other hold-release means is suitable for the channel environment and has characteristics substantially similar to magnets of equal pull limit, with regard to the ability to hold the grid, to automatically release the grid when pressure against its front overcomes the holding ability (referred to as pull limit in regard to a magnet) of the magnets and/or other hold-release means, to then automatically resume holding the grid, and to repeat such cycle as often as deemed necessary by the user. See, U.S. patent application Ser. No. 10/794,664 filed by Nino, published on Sep. 9, 2004, as #US20040173513. And, an approach has been presented in which an upwardly biased trip plate is rotatably attached by its forward edge to the rear of a rotatable catch basin inlet gate, the bias urging the plate into a perpendicular relationship with the closed (vertically oriented) gate, the plate having a pin extending laterally from each side, proximate the rear of the plate, to engage another part that prevents rearward movement of the pins (thus, of the plate and gate), until the weight (or action) of fluid on the plate overcomes the upward bias and the plate rotates downward (its rear edge, and the pins, moving downward), which allows the gate to rotate rearward and open. See, e.g., U.S. Pat. No. 7,234,894 issued (from application Ser. No. 11/335,591) to Flury on Jun. 26, 2007; and, U.S. patent application Ser. No. 11/821,623 file by Flury on Jun. 25, 2007, published on Jan. 17, 2008, as #US2008/0014021 (a continuation-in-part of U.S. application Ser. No. 11/335,591). And, there has been a proposal for a use of a water wheel coupled via a cable, pull rod, etc. to a rotatable gate for opening the gate in response to fluid causing the water wheel to rotate and pull on the cable. See, e.g., U.S. Pat. No. 6,972,088 issued to Yehuda on Dec. 6, 2005.

It is believed that the present invention provides a mechanical system for locking and unlocking a rotatable screen in a fluid channel that offers advantages over and/or desirable alternatives to the prior art relating to control over the opening and/or closing of such a screen.

SUMMARY OF THE INVENTION

The present invention relates to a screen lock-unlock system for automatically locking and unlocking a screen that is installed (or, that is installable, if not already installed) within a fluid channel wherein the installed screen (i.e., the screen as installed within the channel) is rotatable relative to the channel from closed (a rotational position wherein the screen is orientated for blocking at least some trash from moving downstream past the screen) to open (a rotational position wherein the screen is orientated for allowing more trash, relative to what the screen allowed when it was closed, to move downstream past the screen). (References herein to "screen" are intended to include structural features incorporated into the screen for enhancing its rigidity, which move with the screen. A structural feature such as this might, for example, be in the form of a folded portion of the screen made by bending an edge of the screen to be perpendicular to the face of the screen (e.g., a bend resulting in the screen having a cross-sectional shape similar to the letter "L" in the vicinity of the bend), and/or a screen frame fixedly attached to the screen (such as a supporting frame secured to the screen around all or part of the screen's periphery).

The system includes an actuator comprising a flapper and a trigger, wherein the flapper is positioned behind (downstream of) the closed installed screen, the flapper being rotatably connected to the screen for allowing the flapper to rotate about a flapper axis (which is the longitudinal axis of a flapper rotational connector, such as the longitudinal axis of a flapper rod and/or flapper hinge), wherein the flapper axis is oriented generally parallel to a screen axis (which is the longitudinal axis of a screen rotational connector, such as the longitudinal axis of a screen rod and/or screen hinge, about which the screen is rotatable). Preferably, the screen is rotatably connected to the channel by being attached to the screen rotational connector which is connected, proximate each of its left and right ends, to a screen support structure, the screen support structure may include (e.g., for convenience and/or flexibility of installation) a screen bracket for attaching the screen (e.g., via its screen rotational connector) to a channel bracket, the channel bracket being secured (or, securable if not already secured) to the channel. (The channel bracket can be secured to the channel by any available means, e.g., by being anchored, bolted, screwed, and/or adhered to one or more of the channel surfaces. For example, a screen bracket could be secured vertically within the channel by connecting it to channel brackets such as a floor bracket bolted to the channel floor and a ceiling bracket screwed upwardly against the ceiling of the channel, to provide sufficient compression force to hold the screen bracket in place; or, a screen bracket could be secured by connecting it to any other suitable channel bracket, such as an "L" shaped bar, or combination of channel brackets, anchored, bolted, screwed, adhered and/or otherwise secured to a wall, the ceiling, or floor of the channel.)

And, preferably, each flapper rotational connector extends laterally away (e.g., one end toward the left and one end toward the right) from the flapper for rotatably connecting the flapper to, for example, a flapper bracket located on each lateral side of the flapper (preferably with some separation between the flapper's lateral edge and its associated flapper bracket). Preferably, the flapper bracket is fixed to the screen for the flapper rotational connector (e.g., flapper rod) and thus the flapper to be rotatably connected to the screen and to be carried along with the screen as the screen rotates. (As used herein, left and right are relative to the direction for viewing the installed screen in its closed position from a point in front, upstream, of it.) And, the flapper is operably connected to the trigger for moving the trigger (preferably, angularly but alternatively, linearly) in response to rotation of the flapper. (As used herein, "connected," is inclusive of direct and indirect connections, such as via intermediate linking parts, whether or not the parts involved in the connection(s) is/are movable or fixed relative to one another.) Thus, the trigger can be made movable in response to rotation of the flapper by, for example, the trigger and flapper each being fixedly attached to the flapper rotational connector for them to rotate together about the flapper rotational connector's longitudinal axis.

Of course, in some embodiments, either the flapper rotational connector or the screen rotational connector, or each of them, may be, instead of a single—e.g. continuous, full-width—rotational connector, two or more separated, but preferably axially aligned, rotational connectors, such as a pair of short rods with each short rod attached to and extending laterally from, respectively, the left and right side edge of the flapper or screen to which it is attached.

According to one aspect of the system, it also includes a lock bar wherein the lock bar is rotatably attached (or, attachable if not already attached) to the screen support structure, preferably by being rotatably attached to an intermediate lock bar bracket that is fixedly attached (or, attachable if not already attached) to the screen support structure, and wherein the lock bar is rotatable by movement of the trigger within at least some part of the trigger's range of movement. Preferably, the lock bar is an elongated bar made of a strong rigid material, such as steel, and, also preferably, the lock bar is formed (such as by being bent, cast, molded, or made by securing separate parts together) into a shape that includes a bar front portion and a bar back portion, wherein the bar front portion and the bar back portion, as viewed from the side, are oriented at an angle relative to one another. (Preferably, the angle is a right angle such that a cross-sectional side view of the lock bar appears shaped like an "L" turned upside-down. Although, optionally, the angle may be other than 90 degrees or even zero.) The lock bar front portion is located, while the lock bar is in a locked position, for preventing (stopping) the closed installed screen from opening. This can be done by placing the bar front portion within, and therefore blocking, the rearward arc path of a screen blockable part, which may be fixed to or an integral part of the screen. (The blockable part is carried with the screen, in an arc path, as the screen rotates about the axis of the screen rotational connector, e.g., the screen rod). The blockable part preferably is in the form of a flange such as a flapper bracket flange extending laterally from the screen.

The trigger (which could be in the form of, for example, a trigger bar or cam fixed to the flapper rod, or a bent end portion of a flapper rod), is located sufficiently close to the lock bar for rotation of the trigger in response to rearward rotation of the flapper beyond a threshold release angle, to move the lock bar in a direction and amount needed for the forward end of the bar front portion to clear (move downward enough to be out of the rearward arc path of) the blockable part and thereby unlock the screen. (The threshold release angle can be any angle selected for making a particular installation of a screen that has, or will have, an embodiment of the present lock-unlock system connected to it. Presumably such a selection would be based on the installation environment and any operational requirements and/or specifications identified in advance for that installation. And, it is believed that the selected release angle for clearance of the blockable part can readily be determined by those skilled in the art based on the size and configuration of each of the affected parts utilized, and their relationships to one another, for any combination of an embodiment of the system with a screen and its screen support structure, as described and/or shown herein.) Notably, the system can be made to unlock a screen in response to the flapper rotating a fairly small amount from its at-rest position to reach its threshold release angle. (The at-rest position of the flapper being the position at which it comes to rest while the screen is locked closed and while the flapper is not being displaced by fluid and/or trash acting on it.) It is believed that embodiments can be made to operate effectively using a threshold release angle that is reached by the flapper rotating less than 15 degrees.

The flapper is located and oriented with respect to the closed installed screen for at least part of the flapper bottom edge to be impacted by flow-through fluid under at least some fluid flow conditions, flow-through fluid being the fluid that passes through the closed installed screen. (Flow-through fluid, and trash carried with it, that impacts—i.e., presses against—the flapper is referred to herein collectively as impact fluid.) The flapper is rotatable rearward in response to a net pressure of impact fluid that exceeds an amount needed to overcome the frictional and any other forces acting on the actuator in opposition to such rearward movement.

Of course, while the screen is unlocked, it is able to open by rotating rearward in response to pressure of fluid, and trash carried by the fluid, against the screen's front face, thereby allowing at least some previously blocked fluid and trash to flow downstream of the screen. As the flow diminishes, the screen is able to rotate forward (toward closure) until it returns to its closed position. Preferably, the screen's closed position would actually be a range of rotational screen positions within a rotational tolerance allowed for the screen while it is closed, the range of positions being those between a forward rotational limit of the screen (such as a limit imposed by a barrier provided by a screen bracket, a channel bracket, or a portion of the channel floor or inner wall) and the rearward rotational stop limit provided by the bar front portion blocking the path of the screen blockable part while the lock bar is in its locking position.

Preferably, the system also includes a lock bar counter-rotation limiter for blocking counter-rotation of the lock bar beyond its locking position (counter-rotation being rotation in a direction for moving the forward end of the bar front portion upwardly to its blocking position from a position wherein it was clear of the blockable part). Preferably, the lock bar bracket comprises the counter-rotation limiter, which, preferably, is the back edge of the lock bar bracket or may be (or include) a separate piece secured to the lock bar bracket. The counter-rotation limiter preferably would be located in the arc path of the bar back portion, wherein it would stop counter-rotational movement of the bar back portion at a position for placing the bar front portion in its blocking position. And, preferably, the bar back portion would rest against the counter-rotational limiter while the lock bar is in its locking position. For example, the lock bar bracket may have a vertically disposed back edge serving as a counter-rotation limiter that is located and shaped for stopping counter-rotation of the lock bar by stopping its bar back portion as described above, and for allowing positive rotation of the lock bar from its locking position by providing room for both the bar back portion and the bar front portion to move along their respective arc paths with positive rotation of the lock bar. (Positive rotation being rotation in a direction for moving the forward end of the bar front portion downwardly away from its blocking position to clear the blockable part, which generally would be the opposite direction from the counter-rotation direction.) Also, preferably, at least part of the bar back portion is wider than the bar front portion, for enabling the lock bar bracket to be placed at a location wherein it is inside the arc path of the wider part of the bar back portion while being outside the arc path of the narrower bar front portion, thus enabling the back edge of the lock bar bracket to serve as the counter-rotation limiter.

Preferably, the bar back portion is sized, shaped, and positioned to also act as a counterweight to the bar front portion, for biasing the lock bar in a counter-rotation direction to at least help hold the lock bar in and/or return it to a locking position. Although, in alternative embodiments, the bar back portion may be replaced or supplemented by any other biasing device, such as a spring or other source of tension or compression force acting on the lock bar for biasing the lock bar in a counter-rotation direction.

Preferably also, the lock bar includes a manual-unlock part for enabling a person to manually unlock the lock bar from the upstream side of the closed installed screen to help facilitate opening the screen for such things as inspection, repair and/or cleaning. For example, the bar back portion of the lock bar may, in addition to doing other things noted herein, serve as the manual-unlock part, particularly if the bar back portion is downwardly oriented and can be accessed and manipulated via a probe or key inserted through an opening in the screen to unlock the lock bar.

And, preferably, the flapper has a flapper main section and a flapper bottom section wherein the bottom section includes the flapper bottom, with at least part of the bottom section (e.g., the bottom edge) located forward of the main section, for at least part of the bottom section to intercept downwardly flowing impact fluid at an angle greater than the angle between the main section and such fluid. Also preferably, the flapper additionally has a flapper top section wherein the top section includes the flapper top, with the portion of the flapper top attached to the flapper rotational connector being located forward of at least some of the main section (preferably, forward of the flapper's center of gravity), for increasing the angle at which at least part of the main section will intercept downwardly flowing impact fluid. Thus, preferably, where the flapper has such a bottom section and/or a top section oriented differently from its main section, the orientations of the bottom and top sections are selected for increasing—relative to a flapper without bottom and/or top section(s) oriented differently from its main section—the area and angle of impact by flow-through fluid against the main and/or bottom section(s) of the flapper, thus increasing the effect on the flapper of a given depth and rate of flow-through fluid, particularly flow-through fluid that is descending (e.g., from the upper portion of the screen, as might be the case if the lower front of the screen is clogged with trash forcing incoming fluid to flow over the clogged portion) when it impacts the flapper.

The present invention also relates to all embodiments of such a system.

BRIEF DESCRIPTION OF THE DRAWINGS

The present invention will be more clearly understood by reference not only to this specification (including its claims) but also to the accompanying drawings, in which:

DETAILED DESCRIPTION OF PREFERRED EMBODIMENT

As used herein, unless expressly stated otherwise, the following terms have the definitions referred to or specified in this paragraph. The term "embodiment" means embodiment of the present invention. The term "trash" has the meaning given to it in the BACKGROUND OF THE INVENTION section, with the predetermined size being whatever size of trash the user of the screen wishes to specify for being blocked from passing to the downstream side of the closed installed screen (with due consideration to the fact that some trash that is non-rigid or that has a dimension smaller than the predetermined size might not be blocked). The terms "left" and "right" are intended to mean such directions as viewed from the upstream side of the blocker. The term "front" means the upstream side and the term "back" means the downstream side. The terms "vertical" and "horizontal" are intended to include directions that are substantially vertical and substantially horizontal, respectively. The term "predetermined release conditions" means the conditions of depth and flow rate of flow-through fluid that are deemed by the user of the apparatus to be the appropriate conditions for shifting priority from blocking trash to releasing it into the downstream part of the channel.

Figure 1:
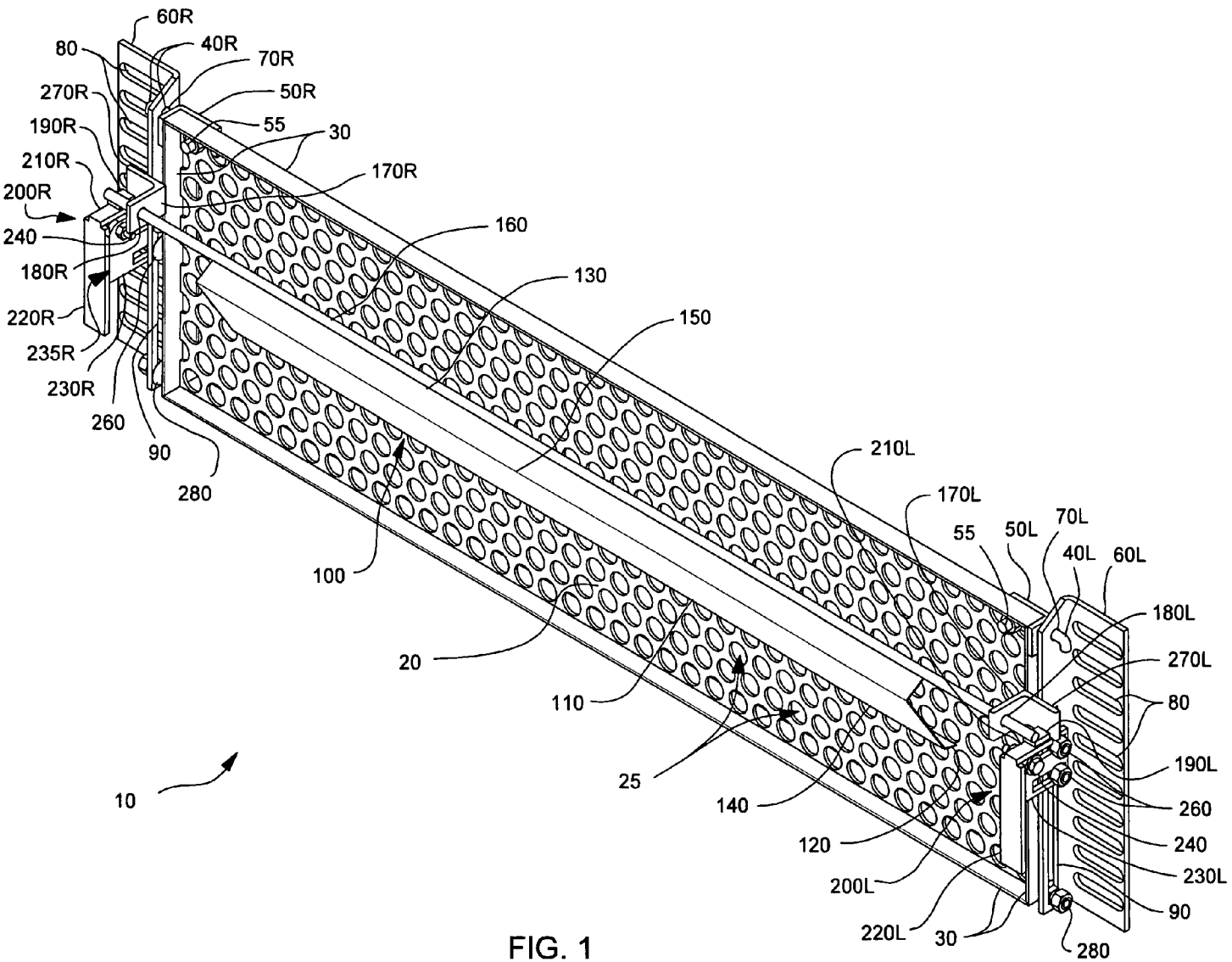
FIG. 1 is a rear-quarter perspective view of a preferred embodiment of the system shown in relation to an uninstalled screen in its closed configuration, separated from any fluid channel installation environment.

Referring to the drawings, FIGS. 1-12 show a preferred embodiment of an automatic fluid channel screen lock-unlock system 10 that is attached to a catch basin inlet screen 20 that has a plurality of apertures 25 through it. As seen first in FIG. 1, in this embodiment, the screen 20 includes a frame 30 around its periphery and is supported by left and right screen rods 40L,40R that are shown extending laterally from left and right screen rod supports 50L,50R, each of which is shown attached to the screen 20 (including its frame 30) by a screen rod support bolt 55. The extended portion of each screen rod 40L,40R protrudes through a respective left or right screen bracket 60L,60R, each of which has a corresponding screen bracket hole 70L,70R for rotatably receiving its respective screen rod 40L,40R. The screen rods 40L, 40R are axially aligned with one another, allowing the screen 20 to rotate about the shared axis of the screen rods 40L,40R. The screen brackets 60L, 60R are shown, initially in FIG. 1, with optional horizontal cutouts 80, which allow some fluid 85 (not shown in FIG. 1 but see FIGS. 7-12) to flow through each of the screen brackets 60L,60R and allow each screen bracket 60L, 60R to be bolted to a separate channel bracket (not shown in FIG. 1 but shown as floor brackets 330L,330R in FIGS. 4 and 7-12) for securing the respective screen bracket 60L,60R to a catch basin inlet channel 75 (not shown in FIG. 1, but see FIGS. 4 and 7-12). And, as first shown in FIG. 1, each of the screen brackets 60L,60R has a vertical slot 90. The system 10 is seen as including a flapper 100, and, preferably, the flapper 100 is a single sheet of material (preferably metal) that is bent to form a flapper main section 110, a flapper bottom section 120, and a flapper top section 130. As seen in FIG. 1, the main section 110 is connected to the bottom section 120 along a bottom bend line 140 and is connected to the top section along a top bend line 150, with the bottom and top sections 120,130 each bent in a forward direction relative to their respective bend lines 140,150. Alternatively, the flapper 100 may have more than two bends, only one bend, or no bend at all, and some or all of the bends and/or other portions of the flapper may be replaced by other (e.g., more gradual and/or more complex) forms of curvature. And, in other alternative embodiments, the flapper may be made from more than one part (e.g., more than one sheet of metal) instead of from only one part (e.g., a single sheet of metal), with the parts connected together to form a shape similar to that described herein.

The flapper 100 as shown in FIG. 1 is fixedly attached (such as by being welded, clamped, or adhered) along its upper edge to, and suspended from, a flapper rod 160. The flapper rod 160 extends laterally from each of the left and right sides of the flapper 100, and is supported at a location behind the screen 20, by a left flapper bracket 170L and a right flapper bracket 170R. Each of the left and right flapper brackets 170L,170R is shown in FIG. 1 fixedly attached (preferably by welding but alternatively by any other available connecting method such as clamping, screwing, bolting, and/or adhering) to the back edge of the frame 30 (although, alternatively, the flapper brackets may be an integral part of the frame itself or, particularly where no frame is utilized, may be fixedly attached directly to the filtering portion of the screen). And, in FIG. 1, each of the flapper brackets 170L,170R has an associated flapper bracket hole 180L,180R, each with sufficient diameter for allowing the flapper rod 160 (and thus the flapper 100) to rotate relative to the screen 20. (Of course, in other embodiments, any other form of bracket capable of being attached to the screen and rotatably supporting the flapper rod, or flapper rods if not a single continuous rod, can be used in place of the form of flapper bracket shown; and/or the flapper bracket holes may be replaced by any other opening or cut out, such as a groove or slot that is capable of rotatably holding up an end portion of the flapper rod.)

In the embodiment shown in FIG. 1, left and right blockable parts 270L,270R are shown as laterally oriented flanges of the respective left and right flapper brackets 170L,170R, which are, as noted above, fixedly attached to the screen 20 (via the screen frame 30). In FIG. 1, the screen is shown locked closed by the lock bars 200L,200R, which is done by each of the lock bar front portions 210L,210R having its forward edge facing toward and blocking rearward travel of its respective associated one of the blockable parts 270L, 270R. (Although this is best seen in FIGS. 6, 7, and 9, since in FIG. 1 the forward edge of the left bar front portion 210L is difficult to see and the forward edge of the right bar front portion 210R is obscured.) Preferably, as seen by reference to FIGS. 5, 6 & 8, each of the bar front portions 210L,210R is located for its respective one of the bar front portions 210L, 210R to be slightly spaced apart from its associated one of the lockable parts 270L,270R while the screen 20 is locked closed, to allow for rotation of the bar front portions 210L, 210R in a direction that moves their forward edges downward (positive rotation), in order to unlock the screen 20 for allowing its rearward rotation, without causing the forward edges of the bar front portions 210L,210R to become jammed by the blockable parts 270L,270R (which, as noted, are fixedly attached to the screen). (This spaced-apart relationship between the forward edges of the bar front portions and the blockable parts also facilitates return of the bar front portions to their blocking positions when the screen closes.)

And, FIG. 1 shows a left and right trigger 190L,190R, each fixed to its respective end of the flapper rod 160. Each trigger 190L,190R shown in FIG. 1 is located preferably slightly above its associated one of a left and right pair of lock bars 200L,200R (shown in FIG. 1 as comprising forwardly disposed bar front portions 210L,210R and downwardly disposed bar back portions 220L,220R). The amount of this separation can be selected based on the desired amount of allowance (tolerance) for angular movement of the flapper from its at-rest position before one or both of the triggers 190L,190R makes contact with its respective lock bar 200L, 200R. Although each of the triggers 190L,190R is shown in FIG. 1 in the form of a small bar, either or both of them could alternatively be any other shape that, when rotated sufficiently (preferably a relatively small amount such as approximately 5-10 degrees) by rotation of the flapper rod 160, can make contact with and, upon further rotation, move its associated lock bar 200L,200R. Examples of such alternative shapes would include (1) a cam attached to the end of the flapper rod 160 and (2) a bent part (preferably bent 90 degrees) of the flapper rod 160, the cam or bend preferably being disposed in the same general direction the bar would have been disposed, e.g., toward the forward direction if being used instead of the forwardly disposed bar-shaped triggers 190L,190R shown in FIG. 1.

FIG. 1 also shows each lock bar 200L,200R rotatably attached respectively to left and right lock bar brackets 230L, 230R. This rotatable attachment is shown made by use of a pivot bolt 240, although alternatively any available rotatable connection device, such as a pin, rod, rivet (if it allows relative rotation between the riveted parts), or hinge, may be used instead. As shown in FIG. 1, each lock bar bracket 230L,230R is fixedly attached to its respective screen bracket 60L,60R by a pair of lock bar bracket bolts 260, which preferably, as shown, can be adjusted up and down within their associated vertical slot 90 in order to adjust the vertical location of their associated one of the lock bar brackets 230L,230R, (and thus the height of the associated one of the lock bars 200L,200R). Each of the lock bars 200L, 200R is rotatable about the axis of its respective pivot bolt 240. Preferably, as shown in FIG. 1, the axis of the pivot bolt 240 is located rearward of the point at which its associated one of the lock bars 200L,200R (which, in FIG. 1, would be the associated one of the bar front portions 210L,210R) is contacted by the associated one of the triggers 190L,190R when the flapper 100 rotates rearward (i.e. its bottom edge moves along a rearward arc) enough for said contact to occur. Thus, as can be seen in FIG. 1, further rearward rotation of the flapper 100 would result in each of the triggers 190L,190R forcing its associated one of the bar front portions 210L,210R to rotate downward (which would result in rearward rotation of the respective bar back portion 220L,220R). (Of course, although not believed preferable, an alternative embodiment could have only one (e.g., left or right) or could have more than two (e.g., more than one left and/or more than one right) trigger, blockable part, lock bar, and/or lock bar bracket.)

And, FIG. 1 shows a screen bracket bottom bolt 280 located and adjustable within each of the vertical slots 90, for connecting each of the screen brackets 60L,60R to a channel bracket (not shown in FIG. 1, but see FIGS. 4, and 7-12) as discussed further below.

Figure 2:
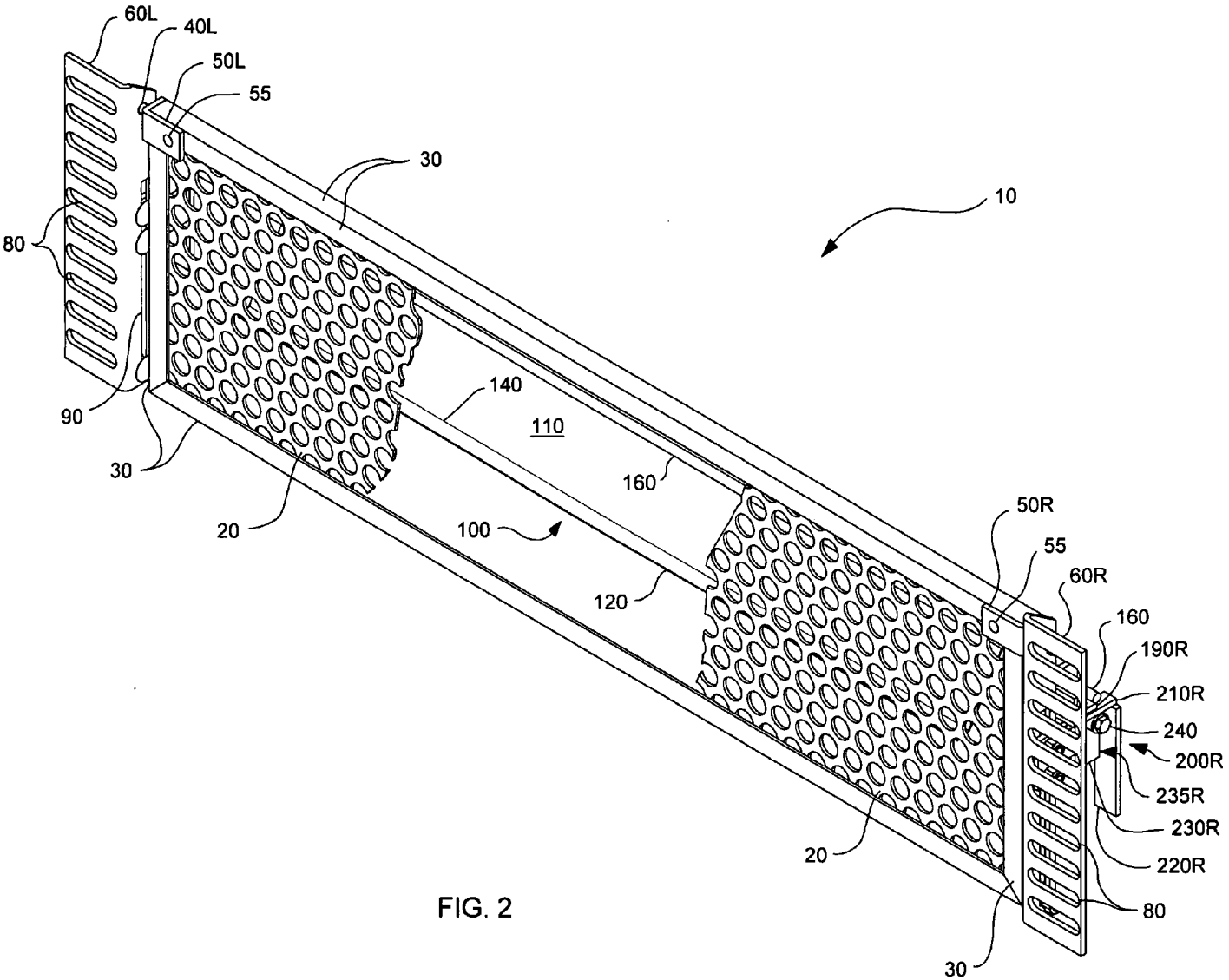
FIG. 2 is a front-quarter perspective view of a preferred embodiment of the system shown in relation to an uninstalled screen in its closed configuration, separated from any fluid channel installation environment.

In FIG. 2, the embodiment shown in FIG. 1 is seen from the opposite perspective view, looking from a position in front and to the right of the screen 20. In FIG. 2, the flapper 100 is shown behind and mostly obscured by the screen 20, except as seen through the cutout portion of the screen 20. FIG. 2 shows the flapper main section 110, the flapper bottom section 120, and the flapper bottom bend line 140 between them. The flapper rod 160, as seen in FIG. 2, obscures the view of flapper top section 130 and flapper top bend line 150 (which, as a result, are not visible in FIG. 2). The right end of the flapper rod 160 is visible in FIG. 2 attached to the right trigger 190R, which is slightly above the right bar front portion 210R. And, the right bar front portion 210R and right bar back portion 220R are shown in FIG. 2 to form the right lock bar 200R, which is rotatably attached via a pivot bolt 240 to the right lock bar bracket 230R.

Figure 3:
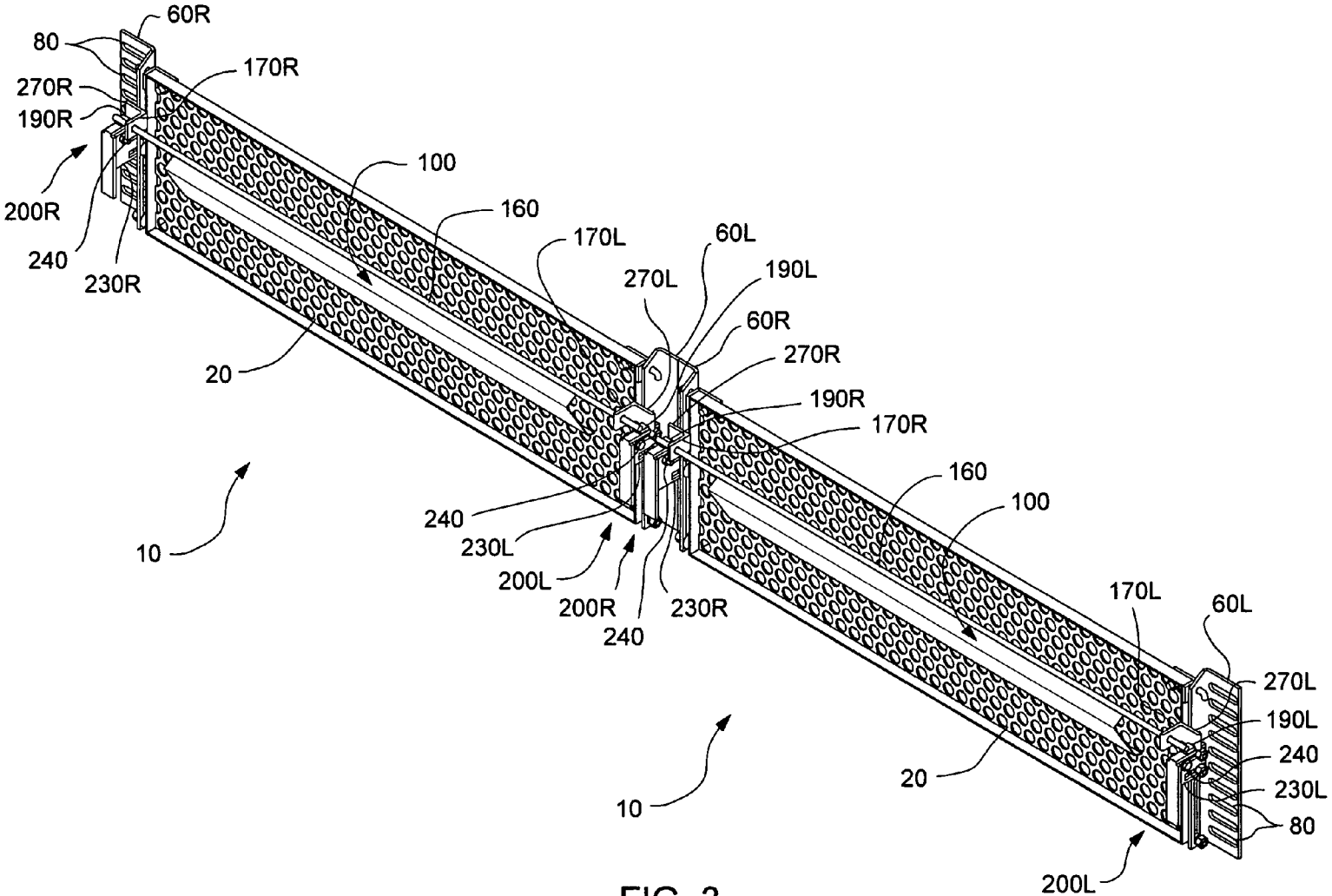
FIG. 3 is a rear-quarter perspective view of the embodiment seen in FIG. 1, shown in relation to each of two uninstalled screens in their closed configurations and connected laterally to one another for fitting a wide channel, separated from any fluid channel installation environment.

FIG. 3 illustrates the adaptability of the system 10 for use on screens 20 that are attached side to side in order to fill a wide channel. In FIG. 3, two screens 20 are aligned side by side for being secured to the channel in a manner that will be discussed further below. As can be seen in FIG. 3, this arrangement can be accomplished with essentially no deviation from the single-screen embodiment as described elsewhere herein. The two screens 20 are shown in FIG. 3 from the same perspective as is the single screen 20 shown in FIG. 1, and are the same embodiment described above in regard to FIGS. 1 and 2, but with the right edge of the right screen bracket 60R for one of the screens placed in contact with (although, alternatively, some separation may be allowed) the left edge of the left screen bracket 60L of the other screen 20. The screen brackets 60L,60R that are brought together in FIG. 3, are shown without the optional horizontal cutouts 80 seen in the screen brackets 60L,60R shown in the other figures, but the absence of this optional feature does not affect the operation of the lock-unlock systems 10 (which are shown in FIG. 3, as they are in the other figures herein, as having flappers 100, flapper rotational connectors (e.g., flapper rods 160), triggers 190L,190R, and screen blockable parts 270L, 270R connected to the screen 20 via flapper brackets 170L, 170R; and, as having lock bars 200L,200R rotatably connected (e.g., by pivot bolts 240) to lock bar brackets 230L, 230R for attachment to the screen brackets 60L,60R.)

Figure 4:
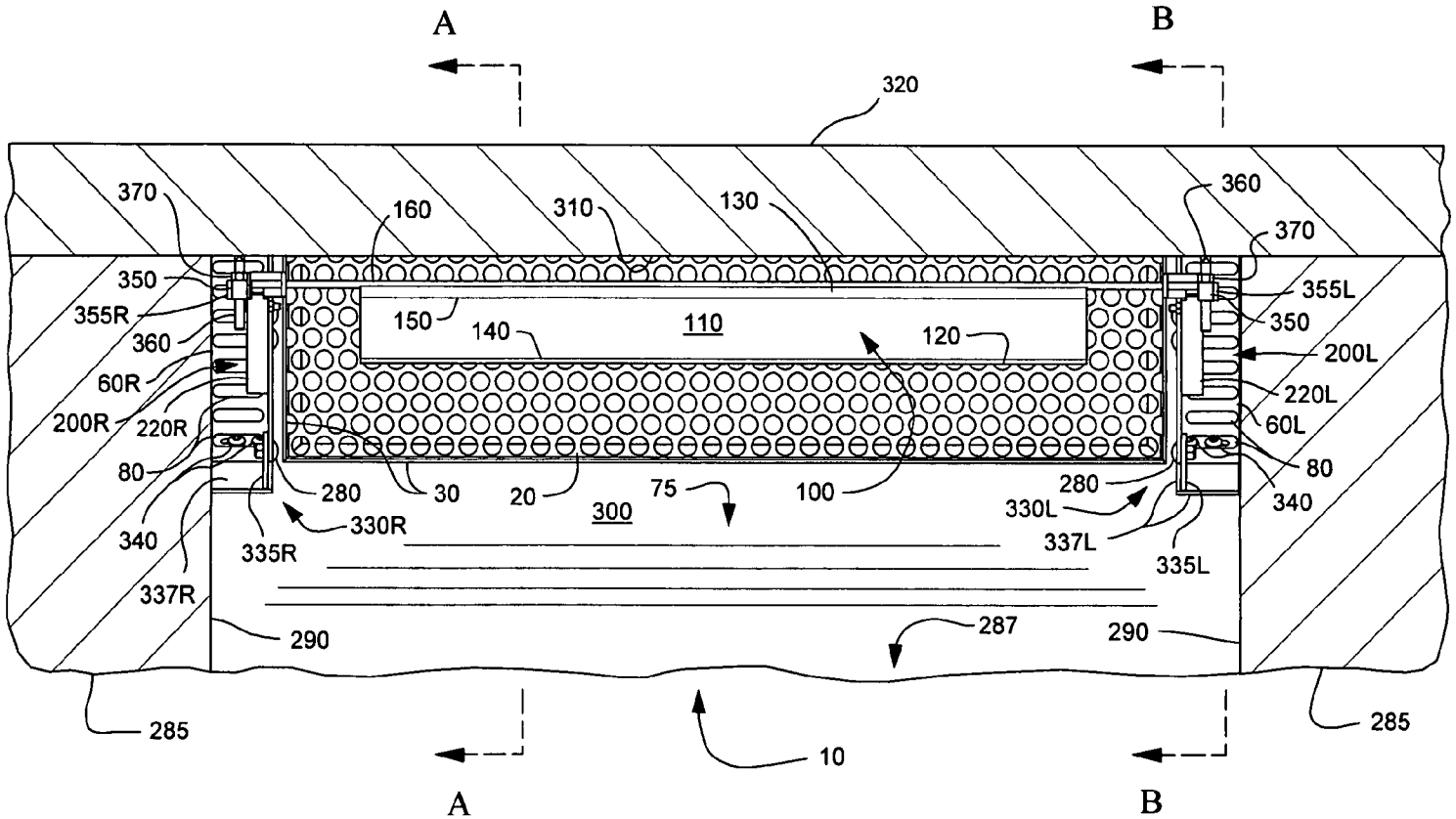
FIG. 4 is a back view (a view seen from a position downstream of the screen) of the embodiment seen in FIG. 1 shown in relation to an installed screen in its closed configuration in a curb inlet channel, as seen through cross-sectional cut C-C (cut shown in FIGS. 7 & 8), from within the associated street storm-water catch basin.
Figure 7:
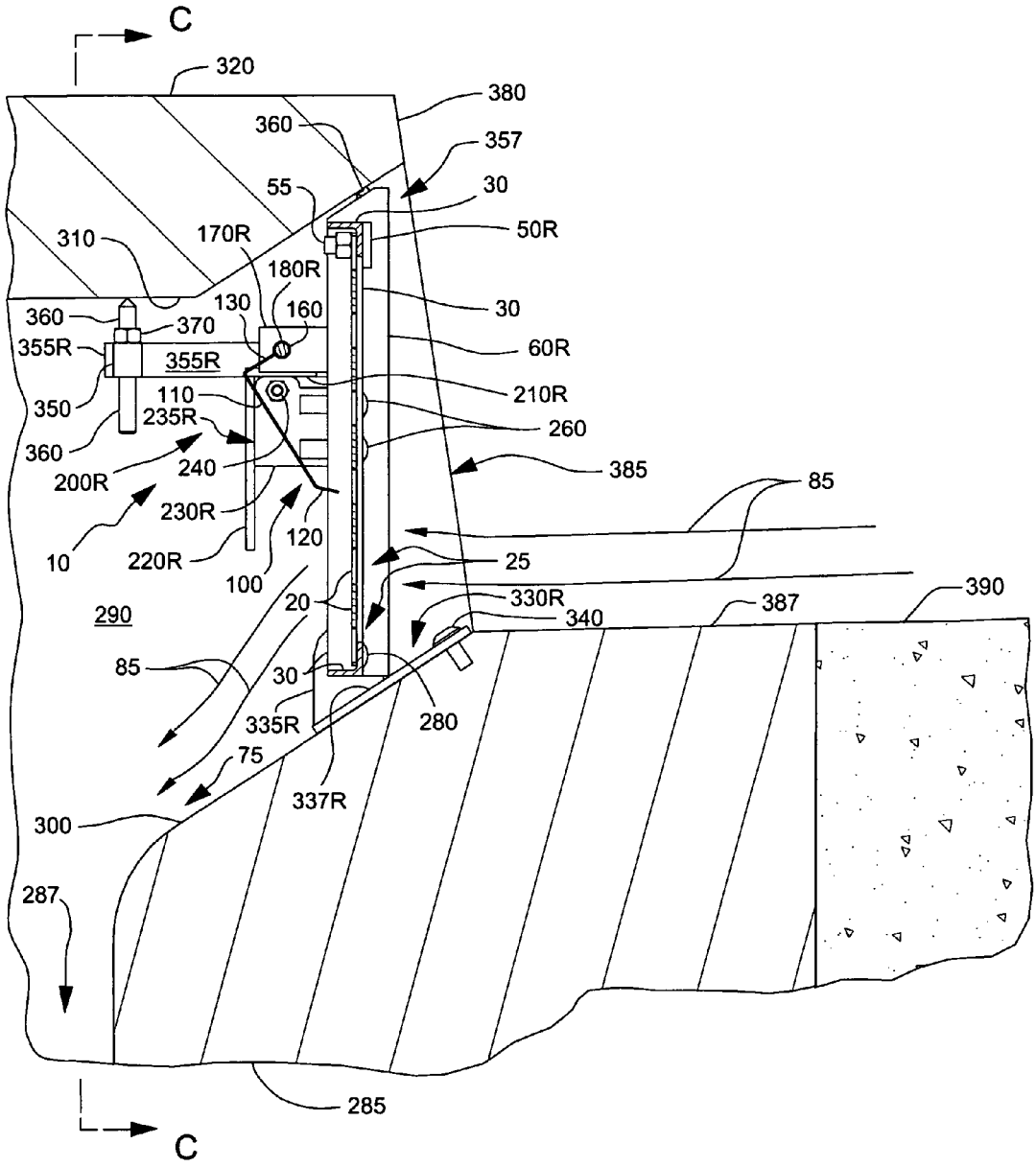
FIG. 7 is a left side view as seen through cross-sectional cut A-A (cut shown in FIG. 4), showing the embodiment seen in FIG. 1, in relation to an installed screen in its closed configuration, in a curb inlet channel with fluid flowing through the channel from the adjacent street.
Figure 8:
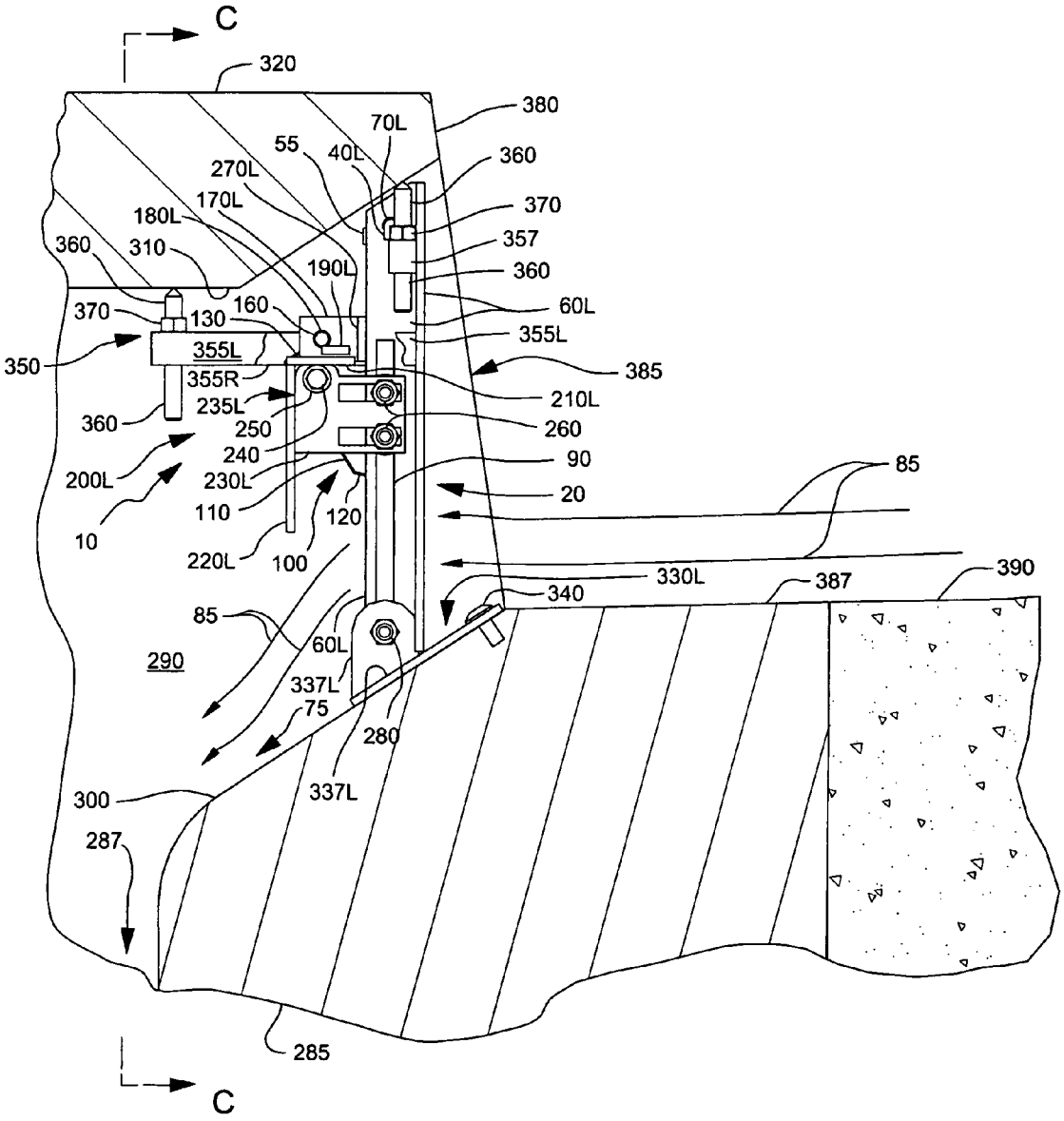
FIG. 8 is a left side view as seen through cross-sectional cut B-B (cut shown in FIG. 4), showing the embodiment seen in FIG. 1, in relation to an installed screen in its closed configuration, in an environment representing a curb inlet channel with fluid flowing through the channel from the adjacent street.
Figure 9:
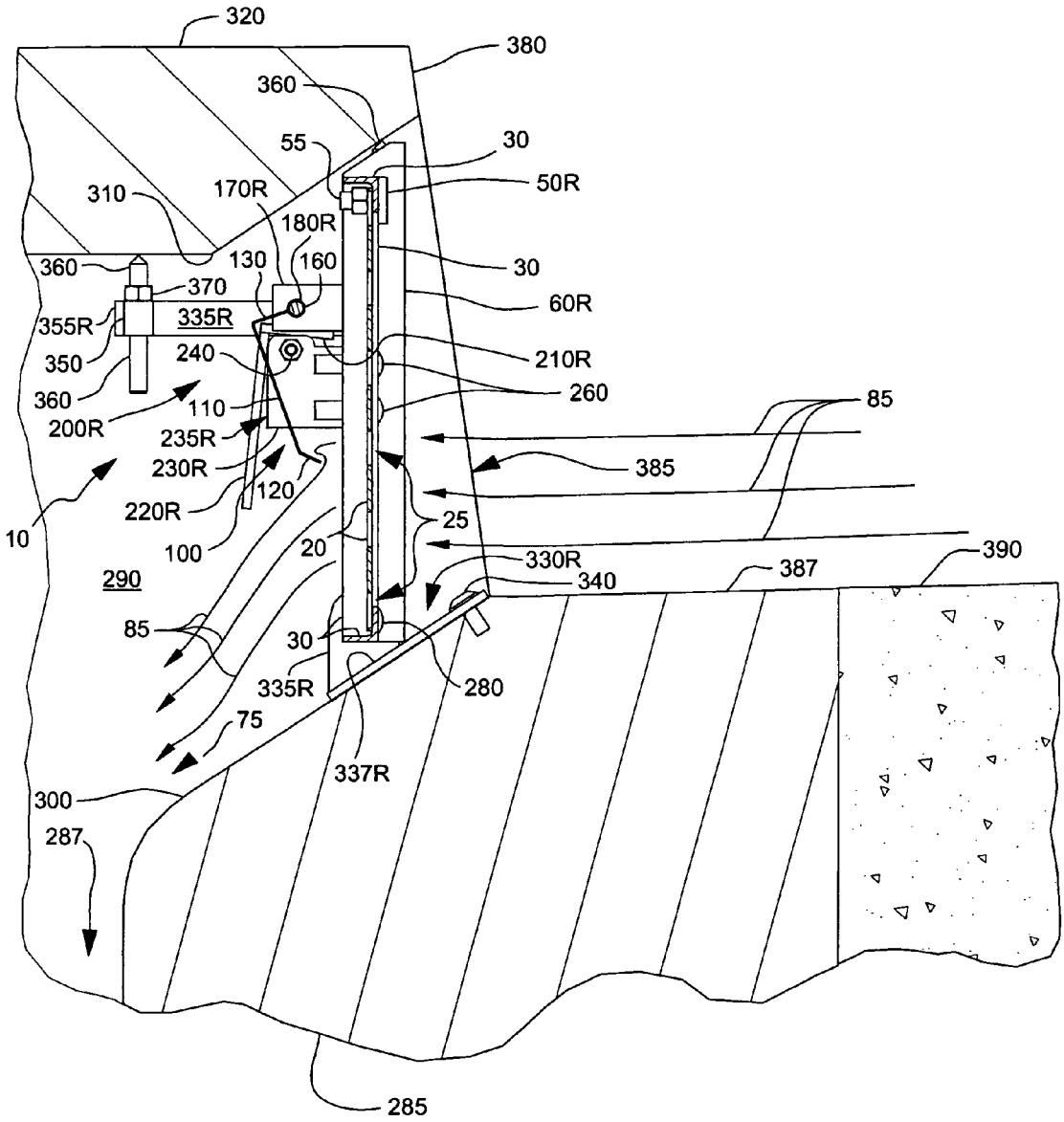
FIG. 9 is a left side view as seen through cross-sectional cut A-A showing the embodiment seen in FIG. 1, in relation to an installed screen in its closed configuration, in a curb inlet channel with fluid flowing through the channel from the adjacent street, and also showing moved positions of the flapper and lock bar as the screen is about to be unlocked.

FIG. 4 shows the same embodiment of system 10, connected to the closed screen 20 and its screen brackets 60L, 60R, as described with reference to FIGS. 1 and 2, but seen through sectional cut C-C (as indicated in FIGS. 7 and 8), after the screen 20 has been installed within a curb inlet channel 75 for a catch basin 285, the inlet channel 75 being defined by channel walls 290, a channel floor 300, and a channel ceiling 310 (which is shown here as the bottom surface of an overlying sidewalk 320). As shown in FIG. 4, a catch basin internal compartment 287 is locate behind and below the inlet channel 75 (this is more clearly illustrated in FIGS. 7-12 discussed below). As shown in FIG. 4, the very top of the screen 20, including the top section of its frame 30, is obscured by the sidewalk 320 (as will be more clearly understood by referring to the cross-sectional profile views seen in FIGS. 7-12). The outside lateral edge of each of the screen brackets 60L,60R is preferably placed snug against its respective associated channel inner wall 290, as seen in FIG. 4. Each of the screen brackets 60L,60R is shown attached via its associated screen bracket bottom bolt 280 to an associated one of left and right floor brackets 330L,330R. Each of the floor brackets 330L,330R is shown comprising one of a pair of vertically disposed floor bracket flanges 335L,335R and a pair of floor bracket plates 337L,337R. Each of the floor bracket flanges 335L,335R is shown fixedly attached (preferably by welding) to its associated one of the floor bracket plates 337L,337R and attached via one of the screen bracket bottom bolts 280 to its associated one of the screen brackets 60L,60R; and, each of the floor bracket plates 337L,337R is shown secured to the channel floor 300 by a pair of channel floor bolts 340 (preferably anchor bolts, but which alternatively may be any other form of connecting device suitable for securing a floor bracket to a channel floor, such as a screws).

The two floor bolts 340 for each of the floor brackets 330L, 330R shown in FIG. 4 are located in front of the associated one of the screen brackets 60L,60R but happen to be visible through a horizontal cutout 80. FIG. 4 also shows each of the screen brackets 60L,60R secured against the channel ceiling 310 by a back ceiling bracket 350 (FIG. 4 substantially hides a front ceiling bracket which is discussed further below in connection with FIGS. 7-12), the back ceiling bracket 350 being fixedly attached to its associated one of the screen brackets 60L,60R and having a compression screw 360 threaded through it, which compression screw 360 is turned until it is tightly pressed against the channel ceiling 310 (and locked by a lock nut 370) for holding the top of its associated one of the screen brackets 60L,60R in place. (These floor and ceiling connections are better understood by also referring to FIGS. 7-12.) (Of course, any available alternative brackets and/or other connectors suitable for doing so may be used to securely attach the screen brackets 60L,60R to the channel, including for example "L" shaped bars for bolting one of the legs of the "L" to a screen bracket and the other leg of the "L" to a part of the channel, such as to the channel ceiling, a channel wall, or the channel floor.) And, the screen brackets 60L,60R themselves could be replaced with any alternative form of brackets and/or other connectors that would be suitable for supporting the screen 20 and/or lock bars 200L,200R and for serving as a base for securing them, directly or indirectly, to the channel while maintaining their ability to rotate and otherwise interact as described and/or shown herein.)

Figure 5:
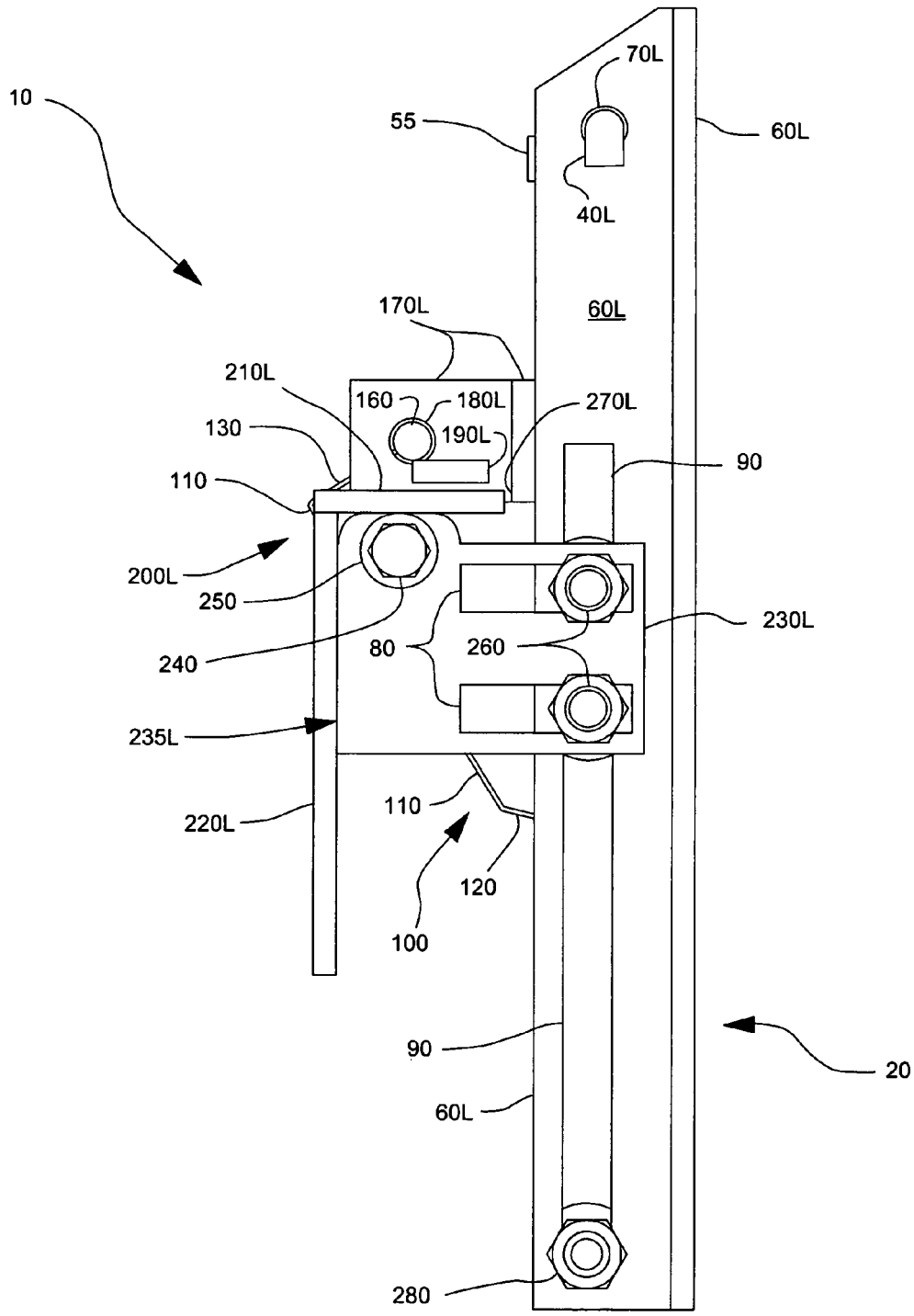
FIG. 5 is a left side view of the embodiment seen in FIG. 1, shown in relation to a screen in its closed configuration, separated from any fluid channel installation environment.
Figure 6:
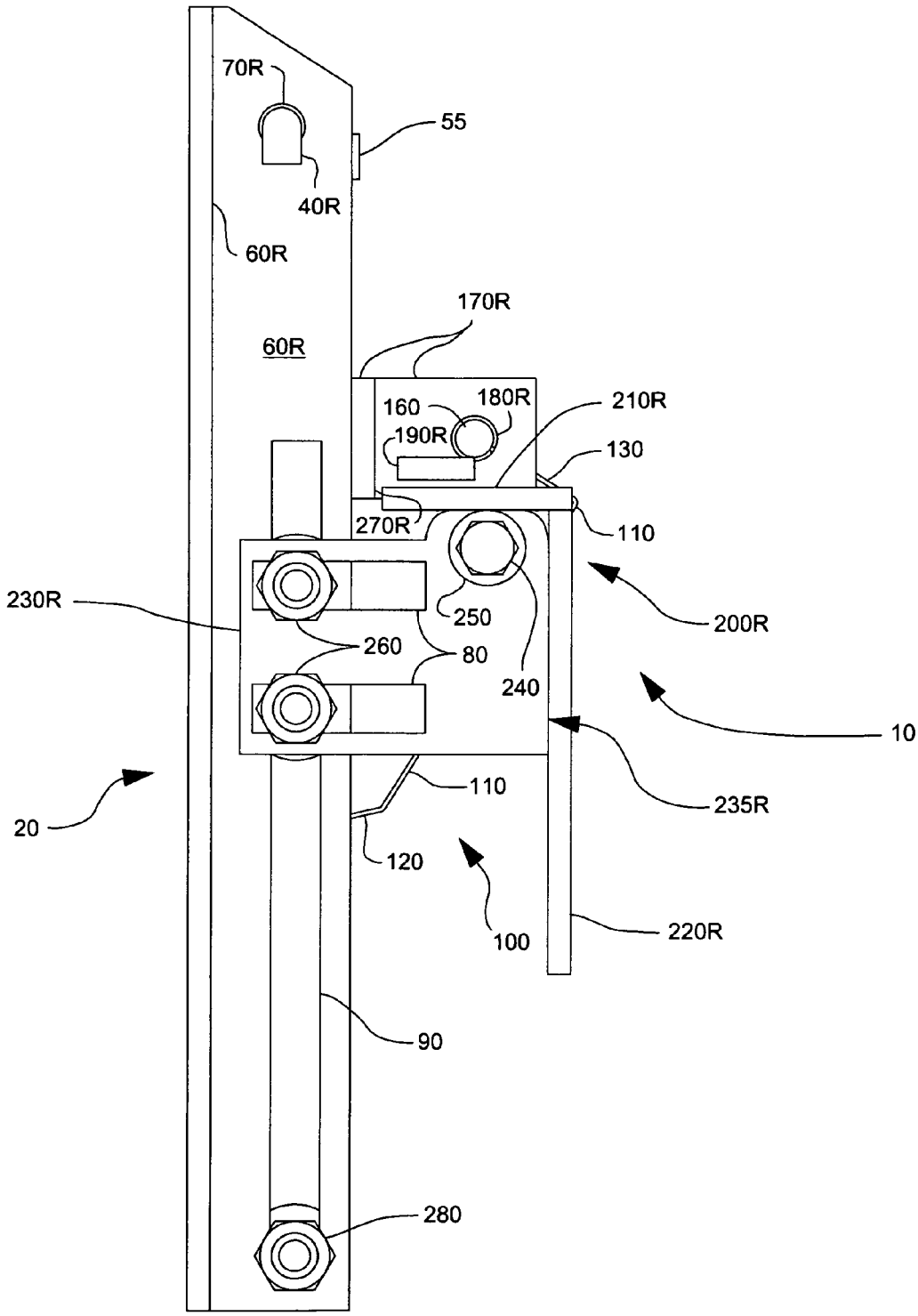
FIG. 6 is a right side view of the embodiment seen in FIG. 1, shown in relation to a screen in its closed configuration, separated from any fluid channel installation environment.

FIGS. 5 and 6 show respectively left and right side views of the embodiment of the system 10 connected to a single-screen structure as shown in FIGS. 1, 2, and 4. (Of course, left and right side views of the system 10 connected to the side-by-side double-screen structure shown in FIG. 3 also would appear the same as the left and right side views seen in FIGS. 5 and 6, since differences visible in FIG. 3 would be hidden if that double-screen structure, with its two system 10*s*, were viewed directly from the left or right side.) FIGS. 5 and 6, like FIGS. 1-3 do not show the installation environment (the channel into which the screen has been or will be installed) or any floor brackets 330L,330R or ceiling brackets 350 for attaching the screen brackets 60L,60R to the channel (but see FIGS. 4, and 7-12). In FIGS. 5 and 6, the screen 20 is shown closed and locked against significant rearward rotation about its screen rods 40L,40R. Each of the screen rods 40L,40R is shown in FIGS. 5 and 6 supported by its associated one of the screen brackets 60L,60R and rotatable within its respective one of the screen bracket holes 70L,70R. (Although each of the screen rods 40L,40R is seen as a downwardly bent end portion of that screen rod in FIGS. 5 and 6, any other available means for preventing the screen rods 40L,40R from slipping out of their screen bracket holes 70L,70R may be used instead). The general location of the screen 20 is indicated by an arrow in FIGS. 5 and 6, although the screen 20 is not visible because, while the screen 20 is closed, it is obscured in these side views by the screen brackets 60L,60R. However, a small portion of the back end of the screen rod support bolt 55 on each side is barely visible protruding rearward beyond the rearward edge of its associated screen bracket 60L,60R.) Portions of the flapper 100, such as parts of the top section 130 and main section 110 and most of the bottom section 120 are visible in FIGS. 5 and 6. Although difficult to see in FIGS. 5 and 6, the flapper top section 130 is fixedly attached to the flapper rod 160, so that the flapper rod 160 is rotated by rotation of the flapper 100. FIGS. 5 and 6 also show each end portion of the flapper rod 160 supported by its associated one of the flapper brackets 170L,170R and rotatable within its respective one of the flapper bracket holes 180L,180R. And, each end of the flapper rod 160 is shown in FIGS. 5 and 6 with one of the triggers 190L,190R fixedly attached to it, so that each of the triggers 190L,190R is rotated by rotation of the flapper rod 160. In FIGS. 5 and 6, the lock bars 200L,200R are shown with associated bar front portions 210L,210R horizontally disposed and with associated bar back portions 220L, 220R vertically disposed. (Preferably, the bar front and back portions are parts of the same piece bent into their positions relative to one another, although alternatively they could be separate pieces attached to one another, preferably fixedly attached, to form their relationship to one another, which need not be limited to a right angle and could even be no angle at all.)

And, preferably, as shown in FIGS. 1-4, each of the bar back portions 220L,220R is wider than its associated one of the bar front portions 210L,210R. Preferably, as shown in FIGS. 5 and 6, the pivot bolt 240 has a pivot bolt sleeve 250 wherein the sleeve 250 is rotatable about the axis of the pivot bolt 240. (This can be accomplished, for example, by the sleeve 250 being fixedly attached to the pivot bolt 240 and the pivot bolt 240 being rotatably connected to its associated one of the lock bar brackets 230L,230R and/or by the sleeve 250 being rotatably attached to the pivot bolt 240.) Each of the bar front portions 210L,210R, as shown in FIGS. 5 and 6, are fixedly attached to the sleeve 250 for the lock bar to rotate about the axis of the pivot bolt 240. FIGS. 5 and 6 show that each of the lock bar brackets 230L,230R is placed for its back edge to serve as one of a left and right pair of counter-rotation limiters 235L,235R, for stopping counter-rotation of its associated one of the bar back portions 220L,220R beyond a point at which its associated one of the bar front portions 210L, 210R is blocking (by being in the rearward arc path of) its associated one of the blockable parts 270L,270R. (Note that, although the right counter-rotation limiter 235R portion of the right lock bar bracket 230R is visible in FIGS. 1-3, the left counter-rotation limiter 235L portion of the left lock bar bracket 230L is hidden in those figures.) And, preferably (as shown by reference to FIGS. 1-8 in view of FIGS. 9-12) the bar front portions 210L,210R are sufficiently narrower than their respective bar back portions 220L,220R for the front portions 210L,210R to clear their associated one of the lock bar brackets 230L,230R and thus allow positive rotation of the lock bars 200L,200R. And, FIGS. 5 and 6 show (as is also evident from reference to FIGS. 1 & 7-12) the upper part of the back edge of each of the lock bar brackets 230L,230R shaped for allowing positive rotation of its associated one of the bar back portions 220L,220R.

Figure 10:
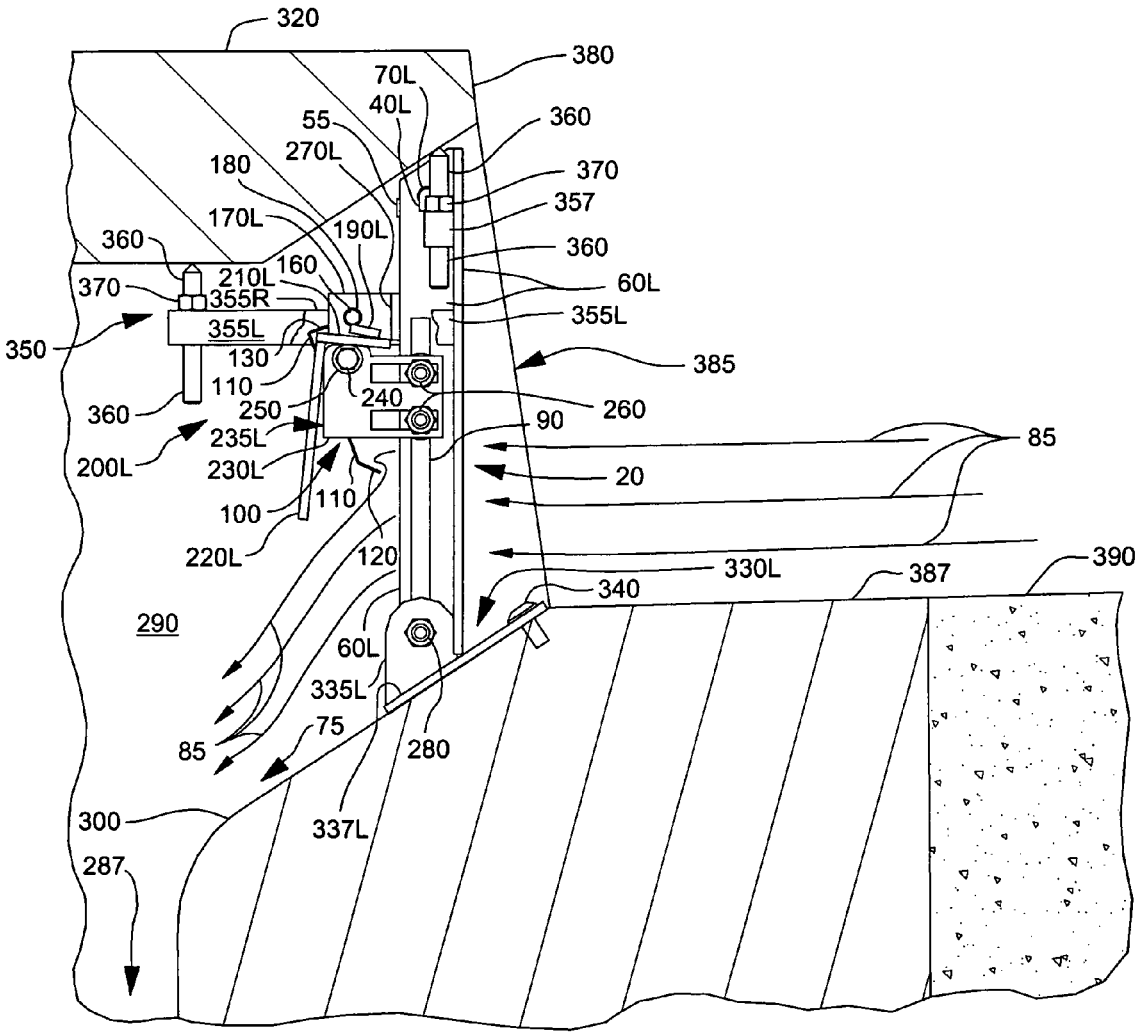
FIG. 10 is a left side view as seen through cross-sectional cut B-B showing the embodiment seen in FIG. 1, in relation to an installed screen in its closed configuration, in a curb inlet channel with fluid flowing through the channel from the adjacent street, and also showing moved positions of the flapper and lock bar as the screen is about to be unlocked.
Figure 11:
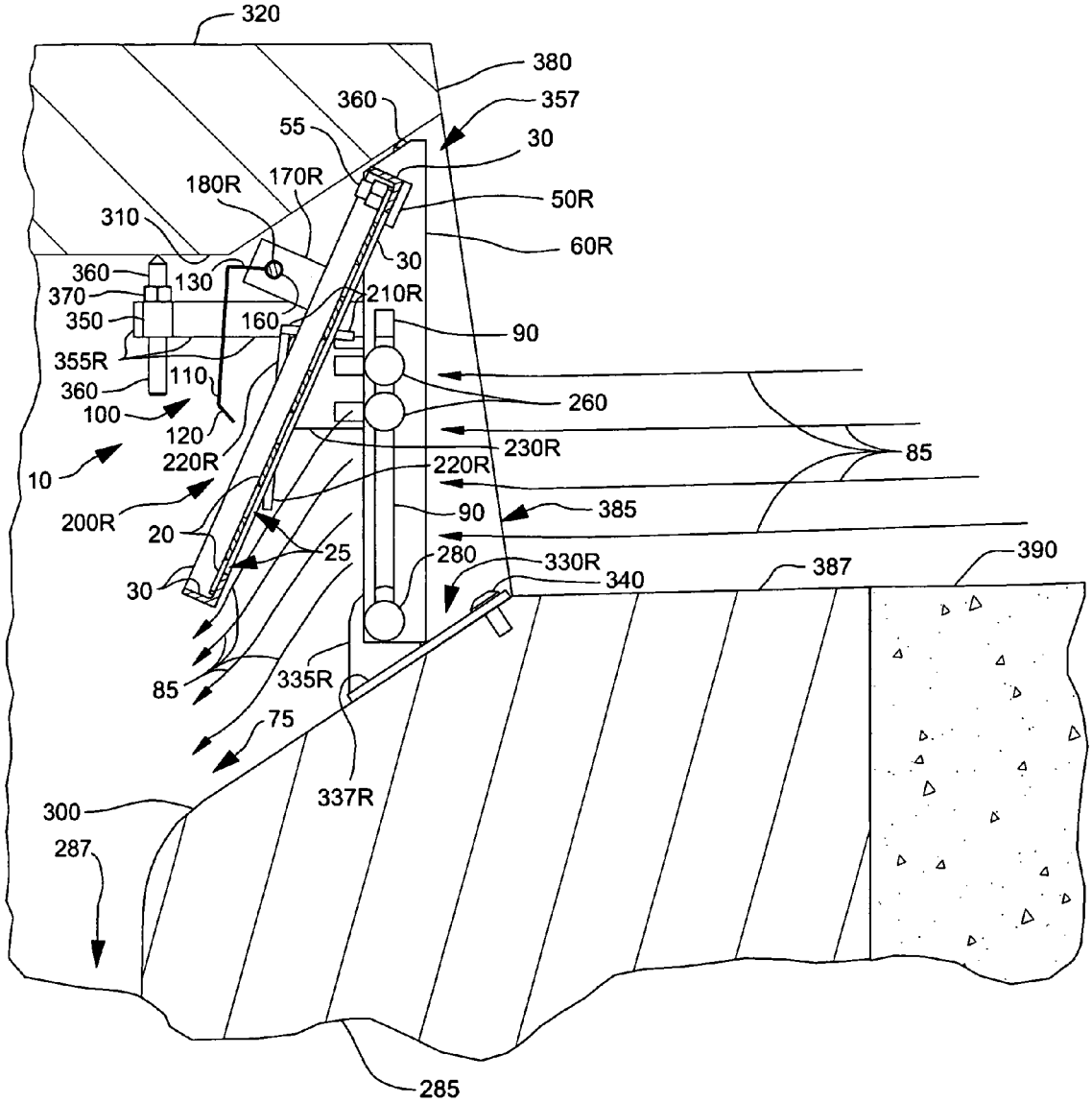
FIG. 11 is a left side view as seen through cross-sectional cut A-A showing the embodiment seen in FIG. 1, in relation to an installed screen in an open configuration, in a curb inlet channel with fluid flowing through the channel from the adjacent street, and also showing moved positions of the flapper and lock bar after the screen has been unlocked and has opened carrying the flapper with it.
Figure 12:
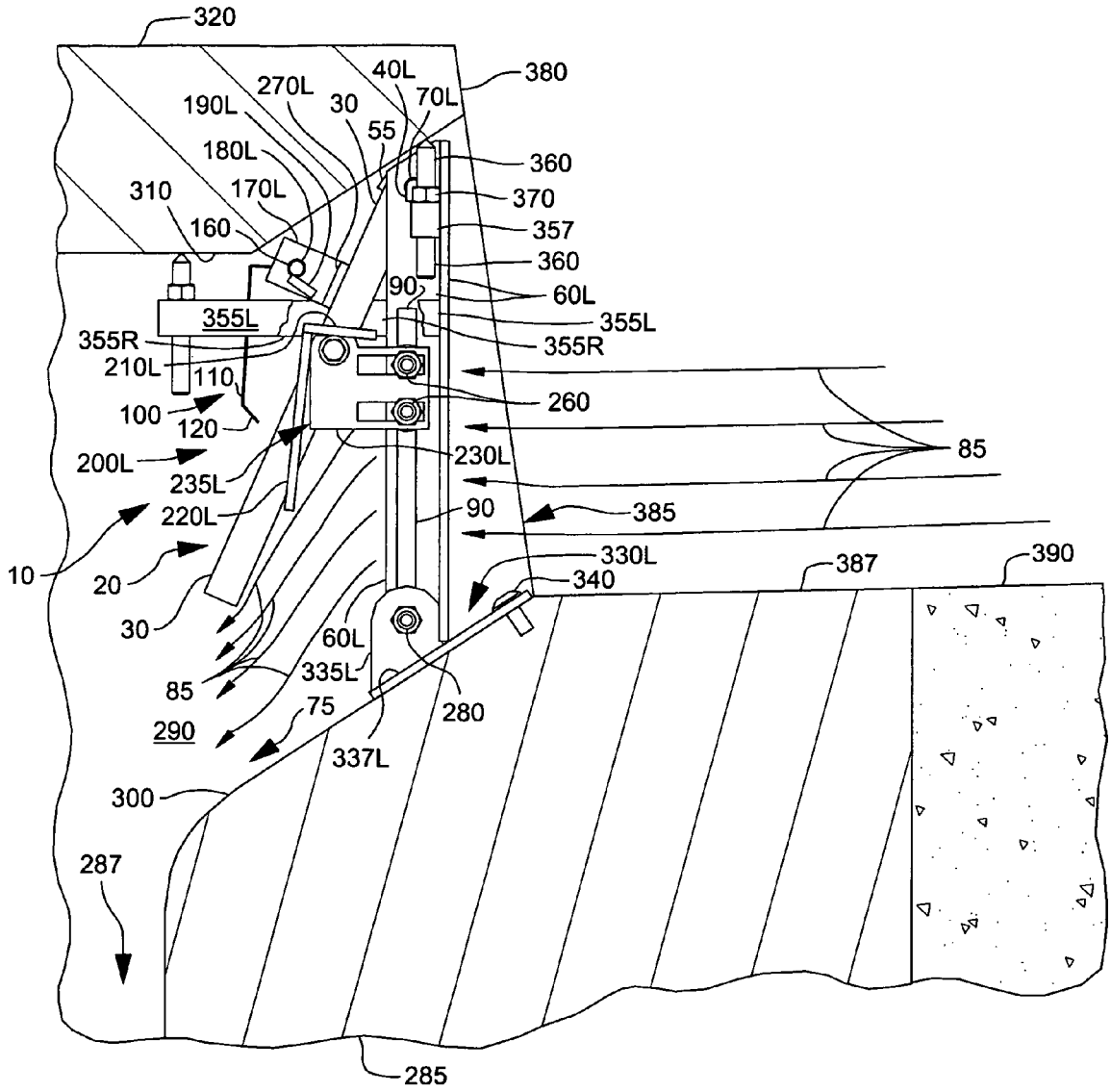
FIG. 12 is a left side view as seen through cross-sectional cut B-B showing the embodiment seen in FIG. 1, in relation to an installed screen in an open configuration, in a curb inlet channel with fluid flowing through the channel from the adjacent street, and also showing moved positions of the flapper and lock bar after the screen has been unlocked and has opened carrying the flapper with it.

FIGS. 7-12 show the embodiment of the system 10 connected to a single-screen structure, as also shown in FIGS. 1, 2, and 4-6. Thus, FIGS. 7-12 (as does FIG. 4) illustrate this embodiment as it would appear with the screen 20 installed in a curb inlet channel 75. (Although screen 20 is visible in FIGS. 7, 9 & 11, it is hidden in FIGS. 8 & 10 which nevertheless indicate its general location.) Thus, each of FIGS. 7-12 illustrates this embodiment located within a catch basin inlet installation environment (which includes an overlying sidewalk 320; a curb 380 with a curb inlet opening 385; the catch basin 285, which includes an apron 387 located in front of the inlet opening 385 for receiving fluid 85 from an adjacent street 390 toward the inlet opening 385, for the fluid 85 to pass into the inlet channel 75 and then into the catch basin's internal compartment 287. (The fluid 85 is shown in the form of arrows indicating the direction of flow, the height of the top arrow being an indicator of the depth of the fluid.) Each of FIGS. 7-12 also show one of the floor brackets 330L,330R; a back ceiling bracket 350 attached to its corresponding one of left and right rearwardly extending ceiling bracket arms 355L,355R (each of which is fixedly attached to its associated one of the screen brackets 60L,60R, with the attachment point hidden in FIGS. 7, 9, & 11, but visible in FIGS. 8, 10, & 12); and, a front ceiling bracket 357 (which, except for the tip of its compression screw 360, is hidden by the right screen bracket 60R in FIGS. 7, 9, & 11 but is visible in FIGS. 8, 10 & 12). As shown in FIGS. 8, 10, & 12, the front ceiling bracket 357 is located in front of the back ceiling bracket 350 which is attached to the left screen bracket 60L, the front ceiling bracket 357 being substantially similar to its corresponding back ceiling bracket 350 (e.g., both having a compression screw 360 and lock nut 370).

Also, for the embodiment shown in FIGS. 7-12, some parts of the system 10 are mounted on respectively the left and right sides of the screen 20 (which, as noted above, includes the screen's frame 30). These parts shown in this embodiment mounted on the frame 30 portion of the screen 20 include the flapper 100; the flapper rod 160; the left and right triggers 190L,190R; and, the left and right flapper brackets 170L, 170R each of which includes a flange that serves as its associated one of the left and right screen blockable parts 270L, 270R. And, as further seen in the embodiment shown in FIGS. 7-12, other parts of the system 10 are mounted on respectively the left and right screen brackets 60L,60R (e.g., the left and right lock bars 200L,200R and their respective lock bar brackets 230L,230R, each of which includes a pivot bolt 240).

In the embodiment as shown in FIGS. 7-12, each part of the system 10 that is located left or right of the center of the screen 20 (left and right being relative to a vantage point directly in front of the screen 20, e.g., from the street 390 as shown in FIGS. 7-12) is a mirror image of its corresponding part located respectively right or left of the center of the screen 20. Thus, with regard to this embodiment of the system 10, a sectional side view looking right from a location between the lateral extremes of the flapper 100 (such as the view through sectional cut A-A, shown in FIGS. 7, 9 & 11) would be a mirror image of a sectional side view looking left from the same location; and, likewise, a sectional side view looking right from the left-side channel inner wall 290 (such as the view through sectional cut B-B, shown in FIGS. 8, 10 & 12) would be a mirror image of a sectional side view looking left from the opposing (right-side) channel inner wall 290. Of course, the identification numbers that include the letter "L" or "R", for designating a part located left or right of the center of the screen 20, would be changed to reverse those letters in an identification number for designating the corresponding part in a mirror-image view. (In alternative embodiments, the corresponding left and right parts may differ, and thus are not required to be the mirror image of one another in order to be within the scope of the present invention.) Note that, in FIGS. 8, 10, & 12, a portion of the left ceiling bracket arm 355L is cut away to reveal parts that would otherwise be hidden by it in those views.

In the embodiment shown in FIGS. 7-12 (as best understood by also referring to FIGS. 1, 2, 5, and 6, and the above discussion of those figures), the frame 30 portion of the screen 20 is rotatably attached to the left and right screen brackets 60L,60R via left and right screen rods 40L,40R (each of which extends laterally outward from its associated one of the left and right screen rod supports 50L,50R, the screen rod supports 50L,50R being secured to the screen 20 and its frame 30 by screen rod support bolts 55).

FIGS. 7, 9 & 11 show the flapper 100 rotatably attached to the screen 20 by the flapper top section 130 being fixedly attached to the flapper rod 160, with the right portion of the flapper rod 160 shown rotatably supported by the right flapper bracket 170R within its right flapper bracket hole 180R; and by the right flapper bracket 170R being fixedly attached to the back edge of the frame 30 portion of the screen 20.

FIG. 7 shows the flapper 100 in its at-rest position, with the screen 20 closed, and shows that the flapper 100 is located for its flapper bottom section 120 to remain above, and thus not be impacted by, at least some fluid 85 that flows past (whether it flows under, around, or through) the screen 20. (The fluid 85 that has flowed past the screen is also referred to herein as the flow-through portion of the fluid or simply the flow-through fluid.) FIGS. 7-12, show a flapper 100 that has a top section 130 with a main section 110 angled forward from its intersection with the top section 130 and has a bottom section 120 angled forward from its intersection with the main section 110, which configuration is believed to enhance the responsiveness of the flapper to any fluid 85 that impacts the bottom section 120 and/or main section 110 with a downward velocity component. (Note that the above-mentioned intersections, with the top section 130 and with the main section 110, are also indicated respectively by the top bend line 150 and bottom bend line 140, which are simply points and thus not visible in FIGS. 7-12 but can be seen in FIG. 1.) Also, as noted above, other embodiments may have a flapper with a different number of sections, or even no separately distinguishable sections, and/or may have a flapper with a different shape (such as a curved cross sectional shape rather than an angular one) or with sections that have different shapes and/or different angular relationships to one another, as compared to those described and/or shown herein.

Thus, especially as can be seen in FIGS. 7 and 8, the location of the flapper 100 (particularly the low edge of the bottom section 120) relative to the screen 20, which is shown in those figures installed within the fluid channel 75, determines the threshold height that flow-through portions of the fluid 85 must reach to begin impacting the flapper 100 and thereby begin rotating the flapper 100 rearward. And, it is believed that a determination can be readily made by those skilled in the art for effectively relating the location of the flapper 100 (e.g., its height and distance behind the closed screen) to the desired maximum depth of fluid 85 to be permitted on the front face of the screen 20 before the flapper 100 is to begin rotating rearward in response to the impact of flow-through portions of the fluid 85. This determination, it is believed, could be made based on the disclosures herein and on readily available additional information relating to a particular installation, such as the physical characteristics of the screen 20 (for example, its height and width and permeability to the fluid 85—e.g., the size and number of its apertures 25), the closeness of fit between the screen 20 (including its frame 30) and the surfaces of the fluid channel (e.g., the channel floor 300 and/or inner walls 290), the anticipated speed and/or pressure of the fluid 85 upon reaching the front face of the screen 20, and the physical characteristics of the channel (such as slope and/or surface obstructions of the channel floor 300 and/or inner walls 290) in the vicinity of the closed screen 20 that would have an effect on the speed and/or level of the flow-through portions of the fluid 85.

As discussed further below, the rearward rotation of the flapper 100 will unlock the screen 20. (Preferably, there is some tolerance allowed between commencement of rotation of the flapper 100 and the amount of its rotation needed to unlock the screen 20.) Once unlocked, the screen 20 is able to rotate rearward in response to an accumulated volume of fluid 85 (and/or trash carried with it) pressing against the front of the screen 20.

FIGS. 7 and 8 show the system 10 in a configuration wherein the installed screen 20 is closed and the flapper 100 is in its at-rest position, with the fluid 85 that is shown flowing against the screen 20 (the fluid 85 being shown flowing from the street 390, across the apron 387, and toward the screen 20) producing a flow-through portion of the fluid 85 wherein none of the flow-through portion of fluid 85 impacts the flapper 100 (although, obviously, in reality there may be splashing that causes some of the flow-through portion of fluid to impact the flapper without causing it to move significantly). Thus, as shown in FIGS. 7 and 8, the flapper rod 160 holds the left and right triggers 190L,190R in an angular position that preferably slightly separates the triggers 190L,190R from their respective associated left and right lock bars 200L,200R (specifically, from the bar front portions 210L,210R of the lock bars 200L,200R, in the embodiment shown, at least in part, in FIG. 1). (Note that both triggers 190L,190R are hidden in FIGS. 7, 9 and 11. But, the left trigger 190L is visible in FIGS. 8, 10 & 12, and it is representative of the right trigger 190R since they are the same except that the left trigger 190L is fixedly attached to the left end of the flapper rod 160 and the right trigger 190R is fixedly attached to the right end of the flapper rod 160, as is further shown in FIGS. 1, 5 & 6.).

As further seen by reference to FIGS. 1-3 and 5-8, which show the screen closed and flapper in its at-rest position, the left and right bar back portions 220L,220R are each resting against, and thus blocked against further counter-rotation by, its associated one of the counter-rotation limiters 235L,235R (which, in this embodiment, is a portion of the back edge of the associated one of the lock bar brackets 230L,230R).

FIGS. 9 and 10 show the flow-through portion of fluid 85 at a level that impacts the flapper bottom section 120 with the flapper 100 shown rotated rearward in response to the force of that impact, which rotation also results in rotation of the flapper rod 160 and the left and right triggers 190L,190R. In addition, FIGS. 9 and 10 show the left and right lock bars 200L, 200R positively rotated, resulting in movement of the forward end of their respective bar front portions 210L, 210R downward and movement of the lower part of their respective bar back portions 220L, 220R rearward. As seen in the view provided in FIG. 10 (which, as noted above, serves as a mirror-image representation of the corresponding components located on the opposite side of the flapper's center), the above-mentioned fluid 85 induced rotation of the left trigger 190L has caused it to press downward against and then positively rotate the left bar front portion 210L about the pivot bolt 240 that runs through the left lock bar bracket 230L (the bar front portion 210L being fixedly attached to the pivot bolt sleeve 250 which is rotatable relative to the pivot bolt 240), and thus positively rotate the entire left lock bar 200L including its left bar back portion 220L. In FIG. 10, the left bar front portion 210L is shown rotated (away from its at-rest blocking position as seen in FIGS. 7 and 8) just enough for its front edge to reach a point at which any further positive rotation will cause the left bar front portion 210L to be clear of the rearward arc path of the left screen blockable part 270L.

As seen in FIGS. 11 and 12, the screen 20 is in an open position (shown in FIG. 12 by the position of the frame 30 portion of the screen 20), a position to which the screen 20 was able to rotate only after being unlocked, i.e., only after the left and right bar front portions 210L,210R were rotated enough by their respective associated triggers 190L,190R in response to rotation of the flapper 100 (as indicated in the foregoing discussion with regard to FIGS. 9 and 10), for each of the bar front portions 210L,210R to clear the rearward arc path of its associated one of the left and right blockable parts 270L,270R. As shown in FIGS. 11 and 12, the flapper brackets 170L,170R (together with their respective associated left and right blockable parts 270L,270R, triggers 190L,190R, and flapper bracket holes 180L,180R—270L and 190L being representative of their respective corresponding right-located mirror-image parts 270R and 190R, which are hidden in FIG. 11—and with the flapper rod 160 and flapper 100) are carried with the screen 20. In FIGS. 11 and 12, the fluid 85 is shown with greater depth than the depths shown in FIGS. 7-10, illustrating the effect an increased depth of the fluid 85 would have not only on completing the unlocking of the screen 20 (by rotating the flapper 100 beyond the threshold point shown in FIGS. 9 and 10), but also on forcing the unlocked screen 20 to rotate to the depicted open position and, thus, significantly enlarging the area through which the fluid 85 and any trash carried with it can pass. FIGS. 11 and 12 also show an additional effect the increased depth of the fluid 85 might have by showing the lock bars 200L,200R displaced in a positively rotated position, not by the triggers 190L,190R since they are not close to the lock bars 200L,200R in FIGS. 11 and 12, but by the flow of the fluid 85 against the bar back portions 220L,220R. (Of course, depth may be replaced or supplemented by other factors that determine the amount of force produced by the fluid 85 and/or any trash carried with it acting on other objects, such as the screen 20 and lock bars 200L, 200R. Those other factors might include, for example, the speed, direction, density, and volume of the fluid, and the quantity, size, and weight of the trash.) In the event of fluid-induced rotation of the lock bars 200L,200R, the bar front portions 210L,210R are seen in FIG. 12 as narrow enough to permit them to rotate in a positive direction (potentially exceeding 90 degrees), while adjacent their respective associated lock bar brackets 230L,230R, which allows the bar back portion to rotate substantially out of the way of even a very high depth of fluid 85 flowing past the open screen 20. And, although not shown in FIGS. 11 and 12, some of the fluid 85 may be expected to flow through the screen's apertures 25 even while the screen 20 is fully open.

After the screen 20 has been rotated to an open position by the flow of fluid 85 (such as the position shown in FIGS. 11 and 12) and as the depth of the fluid 85 lowers, the screen 20 (and the lock bars 200L,200R, if displaced by the fluid 85), will be allowed to rotate under the influence of gravity (and any optional biasing device added for enabling and/or assisting such rotation) in a direction moving the screen 20 toward being closed (and, if they were displaced, moving the lock bars 200L,200R toward their respective locking positions). Thus, as the depth of the fluid 85 lowers, the relationships between the system 10 components, as mounted on the screen 20 structure installed in the inlet channel 75 environment shown in FIGS. 4 and 7-12, are able to automatically change as the depth of the fluid 85 diminishes from a high depth that is holding the screen 20 open (such as is illustrated in FIGS. 11 and 12), to a modest depth that allows the screen 20 to close and to become fully locked by the bar front portions 210L, 210R returning to their full blocking positions—e.g., as a result of the lock bars 200L,200R being fully counter-rotated by the counterbalancing effect of their respective bar back portions 220L,220R until each of the bar back portions 220L, 220R is in contact with, and thus blocked from further counter-rotation by, its respective one of the counter-rotation limiters 235L,235R each of which is shown here as a portion of its associated one of the lock bar brackets 230L,230R (such as the relationships shown in FIGS. 7 and 8; and, in FIGS. 1-6, which also show the screen 20 closed and fully locked).

It should be understood that the present invention contemplates and includes all conventional adjustments and modifications to the embodiment(s) described and/or shown herein, including alternate embodiments that have conventional differences in size, shape, proportion, orientation, and/or direction of movement from those described and/or shown herein, without departing from the present invention.

Accordingly, the invention claimed is not limited to the embodiment(s) described and/or shown herein, but encompasses any and all embodiments within the scope of the claims and is limited only by such claims.

What is claimed is:

1. An automatic fluid channel screen lock-unlock system, for installation on an apparatus having a rotatable screen, wherein the system as installed on the apparatus comprises:

a. an actuator comprising a flapper and a trigger, wherein the flapper is rotatably connected to the screen for allowing the flapper to rotate about a flapper axis, wherein the flapper axis is oriented generally parallel to a screen axis, the screen being supported at least in part by a screen support structure and the screen axis being an axis about which the screen is rotatable relative to the support structure, and wherein the flapper is connected to the trigger for moving the trigger in response to rotation of the flapper;

b. a lock bar wherein the lock bar is rotatably attached to the support support structure, the lock bar being rotatable in response to movement of the trigger, wherein the screen includes a blockable part and the lock bar includes a bar front portion and a bar back portion, the bar front portion being located for intercepting a rearward path of the blockable part while the lock bar is in a locked position, for preventing the screen from opening; wherein, c. the flapper is located and oriented with respect to the screen, at least while the flapper is in an at-rest position, for at least part of the flapper to be rotatable rearward in response to pressure from impact fluid; wherein, d. the trigger is located sufficiently close to the lock bar for rotation of the trigger to move the lock bar in a direction and amount needed for at least part of the bar front portion to clear the reward path of the blockable part, thereby permitting the screen to rotate open in response to pressure against the front of the screen, and wherein the screen is rotatable toward a closed position in response to diminishment of the pressure against the front of the screen; wherein, e. the lock bar is biased in a counter-rotation direction by the bar back portion or another biasing device for at least helping hold the lock bar in or returning it to the locked position.

2. The system of claim 1, wherein the flapper comprises a plurality of flapper sections, at least one of the flapper sections being a lower section and at least one other of the flapper sections being an upper section, wherein at least part of the upper section is located higher than the lower section and the lower section extends away from the upper section in a direction angled or curved forward.

3. The system of claim 2, wherein the upper section comprises a main section and the lower section comprises a bottom section.

4. The system of claim 3, further comprising a counter-rotation limiter, the counter-rotation limiter being located for stopping counter-rotation of the lock bar at the locked position.

5. The system of claim 2, wherein the upper section is a top section and the lower section is a main section.

6. The system of claim 5, further comprising a counter-rotation limiter, the counter-rotation limiter being located for stopping counter-rotation of the lock bar at the locked position.

7. The system of claim 2, further comprising a counter-rotation limiter, the counter-rotation limiter being located for stopping counter-rotation of the lock bar at the locked position.

8. The system of claim 1, further comprising a counter-rotation limiter, the counter-rotation limiter being located for stopping counter-rotation of the lock bar at the locked position.

9. An automatic lock-unlock system for a screen in a fluid channel, the system comprising:

a. a flapper located behind the screen, the flapper having a flapper front side, the flapper front side facing generally toward the screen while the flapper is in an at-rest position, wherein the flapper is rotatable about a flapper axis for allowing rearward rotation of the flapper relative to the screen in response to pressure from impact fluid against the flapper front side;

b. a trigger, wherein the trigger is movable in response to the rearward rotation of the flapper;

c. a lock bar wherein the lock bar is movable between a locking position and an unlocking position in response to movement of the trigger, the screen comprising a blockable part wherein the blockable part moves along a path in response to rearward movement of at least part of the screen, wherein at least part of the lock bar intercepts the path while the lock bar is in the locking position, for blocking the movement of the blockable part and thereby preventing the rearward movement of the at least part of the screen beyond a closed position, and wherein the lock bar clears said path while the lock bar is in the unlocking position, for allowing the rearward movement of the at least part of the screen from the closed position to an open position; and, d. a biasing device, the biasing device operating upon the lock bar for holding the lock bar in or returning the lock bar to the locking position.

10. The system of claim 9, wherein the flapper front side comprises one or more angles or curves, wherein at least some part of the flapper front side is angled or curved forward relative to an adjacent part of the flapper front side.

11. The system of claim 10 wherein the lock bar is rotatable about a lock bar axis and movement of the lock bar between the locking position and the unlocking position includes rotation about the lock bar axis.

12. The system of claim 11, wherein the lock bar comprises a bar front portion and a bar back portion, the bar front portion being located at least in part forward of the lock bar axis and the bar back portion being located at least in part rearward of the lock bar axis, wherein the bar back portion serves as a biasing device for at least helping to counterbalance the bar front portion.

13. The system of claim 12, further comprising a counter-rotation limiter, the counter-rotation limiter being located for stopping counter-rotation of the lock bar at the lock bar locking position.

14. The system of claim 11, further comprising a counter-rotation limiter, the counter-rotation limiter being located for stopping counter-rotation of the lock bar at the lock bar locking position.

15. The system of claim 9 wherein the lock bar is rotatable about a lock bar axis and movement of the lock bar between the locking position and the unlocking position includes rotation about the lock bar axis.

16. The system of claim 15, wherein the lock bar comprises a bar front portion and a bar back portion, the bar front portion being located at least in part forward of the lock bar axis and the bar back portion being located at least in part rearward of the lock bar axis, wherein the bar back portion serves as a biasing device for at least helping to counterbalance the bar front portion.

17. The system of claim 16, further comprising a counter-rotation limiter, the counter-rotation limiter being located for stopping counter-rotation of the lock bar at the locking position.

18. The system of claim 17, further comprising a lock bar bracket for supporting the lock bar, wherein the lock bar bracket comprises the counter-rotation limiter, the counter-rotation limiter being an integral or attached part of the lock bar bracket.

19. The system of claim 15, further comprising a counter-rotation limiter, the counter-rotation limiter being located for stopping counter-rotation of the lock bar at the locking position.

20. The system of claim 19, further comprising a lock bar bracket for supporting the lock bar, wherein the lock bar bracket comprises the counter-rotation limiter, the counter-rotation limiter being an integral or attached part of the lock bar bracket.

* * * * *

UNITED STATES PATENT AND TRADEMARK OFFICE

CERTIFICATE OF CORRECTION

PATENT NO. : 7,951,291 B2
APPLICATION NO. : 12/154603
DATED : May 31, 2011
INVENTOR(S) : Khalil Ibrahim Nino It is certified that error appears in the above-identified patent and that said Letters Patent is hereby corrected as shown below:

Column 19: at line 24, one of the two words in "support support" should be deleted to leave only the one word --support--.

Column 19: at both line 62 and line 63, "is" should read --comprises--.

Signed and Sealed this
Twelfth Day of July, 2011

David J. Kappos

David J. Kappos
*Director of the United States Patent and Trademark Office*